US007574354B2

(12) United States Patent
Lamblin et al.

(10) Patent No.: US 7,574,354 B2
(45) Date of Patent: Aug. 11, 2009

(54) TRANSCODING BETWEEN THE INDICES OF MULTIPULSE DICTIONARIES USED IN COMPRESSIVE CODING OF DIGITAL SIGNALS

(75) Inventors: Claude Lamblin, Perros Guirec (FR); Mohamed Ghenania, Le Mans (FR)

(73) Assignee: France Telecom, Paris (FR)

( * ) Notice: Subject to any disclaimer, the term of this patent is extended or adjusted under 35 U.S.C. 154(b) by 396 days.

(21) Appl. No.: 10/582,126

(22) PCT Filed: Nov. 24, 2004

(86) PCT No.: PCT/FR2004/003008

§ 371 (c)(1),
(2), (4) Date: Oct. 6, 2006

(87) PCT Pub. No.: WO2005/066936

PCT Pub. Date: Jul. 21, 2005

(65) Prior Publication Data

US 2007/0124138 A1 May 31, 2007

(30) Foreign Application Priority Data

Dec. 10, 2003 (FR) ..... 03 14489

(51) Int. Cl.
*G10L 19/12* (2006.01)

(52) U.S. Cl. ..... 704/223; 704/219

(58) Field of Classification Search ..... 704/219–223
See application file for complete search history.

(56) References Cited

U.S. PATENT DOCUMENTS

| | | | | |
|---|---|---|---|---|
| 6,687,668 | B2 * | 2/2004 | Kim et al. | 704/223 |
| 6,735,567 | B2 * | 5/2004 | Gao et al. | 704/258 |
| 7,177,804 | B2 * | 2/2007 | Wang et al. | 704/219 |
| 7,203,638 | B2 * | 4/2007 | Jelinek et al. | 704/201 |
| 7,222,070 | B1 * | 5/2007 | Stachurski et al. | 704/207 |
| 7,272,555 | B2 * | 9/2007 | Lee et al. | 704/219 |
| 7,286,982 | B2 * | 10/2007 | Gersho et al. | 704/223 |
| 2001/0027393 | A1 | 10/2001 | Touimi et al. | |
| 2001/0044717 | A1 * | 11/2001 | Ferhaoui et al. | 704/223 |
| 2003/0033142 | A1 | 2/2003 | Murashima | |
| 2003/0177004 | A1 * | 9/2003 | Jabri et al. | 704/219 |
| 2005/0137858 | A1 * | 6/2005 | Heikkinen et al. | 704/205 |

FOREIGN PATENT DOCUMENTS

WO WO 03/058407 A2 7/2003

OTHER PUBLICATIONS

Ghenania et al., "Transcodage intelligent à faible complexité entre les codeurs UIT-T G.729 et 3GPP NB-AMR," CORESA 2004, May 25, 2004, Lille, France, pp. 85-88 (May 26, 2004).

* cited by examiner

*Primary Examiner*—Michael N Opsasnick
(74) *Attorney, Agent, or Firm*—Drinker Biddle & Reath LLP

(57) ABSTRACT

The invention relates to compressive transcoding between pulse coders using multipulse dictionaries in which each pulse occupies a position marked by an index. For each current pulse position supplied by a first coder, a neighborhood $(V_g^e, V_d^e)$ is formed around that position. As a function of the pulse positions accepted by the second coder, pulse positions are selected in an ensemble constituted by a union of the neighborhoods. The second coder finally receives this selection $(s_j)$, involving a number of pulse positions smaller than the total number of pulse positions in the dictionary of the second coder.

23 Claims, 5 Drawing Sheets

(23)
init 0
70
Le → L'e
71
Le = Cst
Ls = Cst
?
72
n
σ
Te (K), Ts (K')
76
Te (K) = Ts (K')
?
77
n
σ
re-init
78
St (Le) = St (Ls)
?
73
n
σ
MAJ → 0
74
0
79
Pe → P'e
80
(24)

TRANSCODING BETWEEN THE INDICES OF MULTIPULSE DICTIONARIES USED IN COMPRESSIVE CODING OF DIGITAL SIGNALS

CROSS-REFERENCE TO RELATED APPLICATIONS

This application is the U.S. national phase of the International Patent Application No. PCT/FR2004/003008 filed Nov. 24, 2004, which claims the benefit of French Application No. 03 14489 filed Dec. 10, 2003, the entire content of which is incorporated herein by reference.

FIELD OF THE INVENTION

The present invention relates to coding and decoding digital signals, in particular in applications that transmit or store multimedia signals such as audio signals (speech and/or sound).

BACKGROUND OF THE INVENTION

In the field of compression coding, many coders model a signal of L samples using a number of pulses very much less than the total number of samples. This is the case of certain audio-frequency coders, for example, such as the "TDAC" audio coder described in particular in the published document US-2001/027393, in which modified normalized discrete cosine transform coefficients in each band are quantized by vectorial quantifiers using algebraic dictionaries of interleaved size, these algebraic codes generally including a few components that are non-zero, the other components being equal to zero. This is also the case with most speech coders using analysis by synthesis, in particular coders of the Algebraic Code Excited Linear Prediction (ACELP), Multi-Pulse Maximum Likelihood Quantization (MP-MLQ) and other types. To model the innovation signal, these coders use a directory composed of waveforms having very few components that are non-zero, having positions and amplitudes that additionally obey predetermined rules.

Coders of the above kind using analysis by synthesis are briefly described below.

In coders using analysis by synthesis, a synthesis model is used on coding to extract parameters modeling the signals to be coded, which may be sampled at the telephone frequency ($F_e$=8 kilohertz (kHz)) or at a higher frequency, for example at 16 kHz for broadened band coding (passband from 50 hertz (Hz) to 7 kHz). Depending on the application and on the required quality, the compression rate varies from 1 to 16. These coders operate at bit rates from 2 kilobits per second (kbps) to 16 kbps in the telephone band and from 6 kbps to 32 kbps in the broadened band.

There follows a brief description of the CELP digital codec, which codec uses analysis by synthesis and is the one most widely used at present for coding/decoding speech signals. A speech signal is sampled and converted into a series of blocks of L' samples called frames. As a general rule, each frame is divided into smaller blocks of L samples called subframes. Each block is synthesized by filtering a waveform extracted from a directory (also called a dictionary) multiplied by a gain via two filters varying in time. The excitation dictionary is a finite set of waveforms of L samples. The first filter is a long-term prediction (LTP) filter. An LTP analysis evaluates the parameters of this LTP filter, which exploits the periodic nature of voiced sounds (typically representing the frequency of the fundamental pitch (the vibration frequency of the vocal chords)). The second filter is a short-term prediction filter. Linear prediction coding (LPC) analysis methods are used to obtain short-term prediction parameters representing the transfer function of the vocal tract and characteristic of the spectrum of the signal (typically representing the modulation resulting from the shape assumed by the lips, the positions of the tongue and of the larynx, etc.).

The method used to determine the innovation sequence is the method known as analysis by synthesis. In the coder, a large number of innovation sequences from the excitation dictionary are filtered by the LTP and LPC filters and the waveform producing the synthetic signal closest to the original signal according to a perceptual weighting criterion, generally known as the CELP criterion, is selected.

The use of multipulse dictionaries in these analysis by synthesis coders is described briefly below, on the understanding that CELP coders and CELP decoders are well known to the person skilled in the art.

The multiple bit rate coder of the ITU-T G.723.1 Standard is a good example of a coder using analysis by synthesis that employs multipulse dictionaries. Here, the pulse positions are all separate. The two bit rates of the coder (6.3 kbps and 5.3 kbps) model the innovation signal by means of waveforms extracted from the dictionary that include only a small number of non-zero pulses: six or five for the high bit rate, four for the low bit rate. These pulses are of amplitude +1 or −1. In its 6.3 kbps mode, the G.723.1 coder uses two dictionaries alternately:

- in the first dictionary, used for even subframes, the waveforms comprise six pulses, and
- in the second dictionary, used for odd subframes, they comprise five pulses.

In both dictionaries, a single restriction is imposed on the positions of the pulses of any code-vector, which must all have the same parity, i.e. they must all be even or they must all be odd. In the 5.3 kbps mode dictionary, the positions of the four pulses are more severely constrained. Apart from the same parity constraint as the dictionaries of the high bit rate mode, there is a limited choice of positions for each pulse.

The 5.3 kbps mode multipulse dictionary belongs to the well-known family of ACELP dictionaries. The structure of an ACELP directory is based on the interleaved single-pulse permutation (ISPP) technique, which consists in dividing a set of L positions into K interleaved tracks, the N pulses being located in certain predefined tracks. In some applications, the dimension L of the code words can be expanded to L+N. Accordingly, in the case of the low bit rate mode directory of an ITU-T G.723.1 coder, the dimension of the block of 60 samples is expanded to 64 samples and the 32 even (or odd as the case may be) positions are divided into four non-overlapping interleaved tracks of length 8. There are therefore two groups of four tracks, one for each parity. Table 1 below sets out the four tracks for the even positions for each pulse $i_0$ to $i_3$.

TABLE 1

Positions and amplitudes of the pulses of the ACELP dictionary of the 5.3 kbps mode G.723.1 coder

| Pulse | Sign | Position |
|---|---|---|
| $i_0$ | ±1 | 0, 8, 16, 24, 32, 40, 48, 56 |
| $i_1$ | ±1 | 2, 10, 18, 26, 34, 42, 50, 58 |
| $i_2$ | ±1 | 4, 12, 20, 28, 36, 44, 52, (60) |
| $i_3$ | ±1 | 6, 14, 22, 30, 38, 46, 54, (62) |

The ACELP innovation dictionaries are used in many standardized coders employing analysis by synthesis (ITU-T G.723.1, ITU-T G.729, IS-641, 3GPP NB-AMR, 3GPP WB-AMR). Tables 2 to 4 below set out a few examples of these ACELP dictionaries for a block length of 40 samples. Note that the parity constraint is not used in these dictionaries. Table 2 covers the ACELP dictionary for 17 bits and four non-zero pulses of amplitude ±1, used in the 8 kbps mode ITU-T G.729 coder, the IS-641 7.4 kbps mode coder and the 7.4 and 7.95 kbps mode 3GPP NB-AMR coder.

TABLE 2

Positions and amplitudes of the pulses of the ACELP dictionary of the 8 kbps mode ITU-T G.729 coder, 7.4 kbps mode IS-641 coder and 7.4 and 7.95 kbps mode 3GPP NB-AMR coder

| Pulse | Sign | Position |
|---|---|---|
| $i_0$ | ±1 | 0, 5, 10, 15, 20, 25, 30, 35 |
| $i_1$ | ±1 | 1, 6, 11, 16, 21, 26, 31, 36 |
| $i_2$ | ±1 | 2, 7, 12, 17, 22, 27, 32, 37 |
| $i_3$ | ±1 | 3, 8, 13, 18, 23, 28, 33, 38<br>4, 9, 14, 19, 24, 29, 34, 39 |

Table 3 covers the ACELP dictionary for 35 bits used in the 12.2 kbps mode 3GPP NB-AMR coder, in which each code-vector contains 10 non-zero pulses of amplitude ±1. The block of 40 samples is divided into five tracks of length 8 each containing two pulses. Note that the two pulses of the same track can overlap and result in a single pulse of amplitude ±2.

TABLE 3

Positions and amplitudes of the pulses of the ACELP dictionary of the 12.2 kbps mode 3GPP NB-AMR coder

| Pulse | Sign | Position |
|---|---|---|
| $i_0$, $i_5$ | ±1 | 0, 5, 10, 15, 20, 25, 30, 35 |
| $i_1$, $i_6$ | ±1 | 1, 6, 11, 16, 21, 26, 31, 36 |
| $i_2$, $i_7$ | ±1 | 2, 7, 12, 17, 22, 27, 32, 37 |
| $i_3$, $i_8$ | ±1 | 3, 8, 13, 18, 23, 28, 33, 38 |
| $i_4$, $i_9$ | ±1 | 4, 9, 14, 19, 24, 29, 34, 39 |

Finally, Table 4 covers the ACELP dictionary for 11 bits and two non-zero pulses of amplitude ±1 used in the low bit rate (6.4 kbps) extension of the ITU-T G.729 coder and in the 5.9 kbps mode 3GPP NB-AMR coder.

TABLE 4

Positions and amplitudes of the pulses of the ACELP dictionary of the 6.4 kbps mode ITU-T G.729 coder and the 5.9 kbps mode 3GPP NB-AMR coder

| Pulse | Sign | Positions |
|---|---|---|
| $i_0$ | ±1 | 1, 3, 6, 8, 11, 13, 16, 18, 21, 23, 26, 28, 31, 33, 36, 38 |
| $i_1$ | ±1 | 0, 1, 2, 4, 5, 6, 7, 9, 10, 11, 12, 14, 15, 16, 17, 19, 20, 21, 22, 24, 25, 26, 27, 29, 30, 31, 32, 34, 35, 36, 37, 39 |

What is meant by "exploring" multipulse dictionaries is explained below.

As with any quantizing operation, seeking the optimum modeling of a vector to be coded consists in selecting from the set (or a subset) of the code-vectors of the dictionary that which "resembles" it most closely, i.e. the one that minimizes the measured distance between it and that input vector. A step referred to as "exploring" the dictionaries is carried out for this purpose.

In the case of multipulse dictionaries, this amounts to seeking the combination of pulses that optimizes the proximity of the signal to be modeled and the signal resulting from the choice of pulses. Depending on the size and/or the structure of the dictionary, this exploration may be exhaustive or non-exhaustive (and therefore more or less complex).

Since the dictionaries used in the TDAC coder referred to above are unions of permutation codes of type II, the algorithm for coding a vector of normalized transform coefficients exploits this property to determine its nearest neighbor from all the code-vectors, calculating only a limited number of distance criteria (using so-called "absolute leader" vectors).

In coders employing analysis by synthesis, the exploration of the multipulse dictionaries is not exhaustive except in the case of small dictionaries. Only a small percentage of dictionaries of higher bit rate is explored. For example, multipulse ACELP dictionaries are generally explored in two stages. To simplify this search, a first stage preselects the amplitude (and therefore the sign, see above) of each possible pulse position by simply quantizing a signal depending on the input signal. Since the amplitudes of the pulses are fixed, it is the positions of the pulses that are then searched for using an analysis by synthesis technique (conforming to the CELP criterion). Despite using the ISPP structure, and despite the small number of pulses, an exhaustive search of the combinations of positions is effected only for the low bit rate dictionaries (typically less than or equal to 12 bits). This applies to the 11-bit ACELP dictionary used in the 6.4 kbps mode G.729 coder (see Table 4), for example, in which the 512 combinations of positions of two pulses are all tested to select the best one, which amounts to calculating the corresponding 512 CELP criteria.

Various focusing methods have been proposed for dictionaries of higher bit rate. The expression "focused search" is then used.

Some of those prior art methods are used in the standardized coders mentioned above. Their aim is to reduce the number of combinations of positions to be explored on the basis of the properties of the signal to be modeled. One example is the "depth-first tree" algorithm used by many standardized ACELP coders, in which preference is given to certain positions, such as the local maxima of the tracks of a target signal depending on the input signal, the past synthetic signal, and a filter composed of synthesis and perceptual weighting filters. There are several variants of this, depending on the size of the dictionary used. To explore the ACELP dictionary for 35 bits and 10 pulses (see Table 3), the first pulse is placed at the same position as the global maximum of the target-signal. This is followed by four iterations by circular permutation of the consecutive tracks. On each iteration, the position of the second pulse is fixed at the local maximum of one of the other four tracks, and the positions of the remaining other eight pulses are searched for sequentially in pairs in interleaved loops. 256 (8×8×4 pairs) different combinations are tested on each iteration, which means that only 1024 combinations of positions of the 10 pulses among the $2^{25}$ of the dictionary can be explored. A different variant is used in the IS641 coder, in which a higher percentage of combinations of the dictionary for 17 bits and four pulses (see Table 2) is explored. 768 combinations of the 8192 ($=2^{13}$) combinations of pulse positions are tested. In the 8 kbps G.729 coder, the same ACELP dictionary is explored by a different focusing method. The algorithm effects an iterative search by interleaving four pulse search loops (one per pulse). The search is focused by making entry into the interior loop (search for the last pulse belonging to tracks 3 or 4) conditional on exceeding an adaptive threshold that also depends on the properties of the target-signal (local maximum values and mean values of the first three tracks). Moreover, the maximum number of explorations of combinations of four pulses is fixed at 1440 (which represents 17.6% of the 8192 combinations).

In the 6.3 kbps mode G.723.1 coder, not all the $2\times2^5\times C_{30}^5$ (or $2\times2^6\times C_{30}^6$) combinations of five (or six) pulses are explored. For each chart, the algorithm employs a known "multipulse" analysis to search sequentially for the positions and the amplitudes of the pulses. As with the ACELP dictionaries, there are variants that restrict the number of combinations tested.

The above techniques suffer from the following problems, however.

The exploration of a multipulse dictionary, even a sub-optimum exploration thereof, constitutes in many coders a costly operation in terms of calculation time. For example, in the 6.3 kbps mode G.723.1 and 8 kbps mode G.729 coders, the search represents close to half the total complexity of the coder. For the NB-AMR coder, it represents one third of the total complexity. For the TDAC coder, it represents one quarter of the total complexity.

It is clear in particular that this complexity becomes critical if a plurality of coding operations have to be carried out by the same processor unit, such as a gateway managing many calls in parallel or a server distributing many multimedia contents. The complexity problem is accentuated by the multiplicity of compression formats circulating on the networks.

To offer mobility and continuity, modern and innovative multimedia communications services must be able to operate under a wide variety of conditions. The dynamism of the multimedia communications sector and the heterogeneous nature of the networks, access points and terminals have generated a plethora of compression formats whose presence in communications systems necessitates multiple coding either in cascade (transcoding) or in parallel (multiformat coding or multimode coding).

The meaning of the term "transcoding" is explained below. Transcoding becomes necessary if, in a transmission system, a compressed signal frame sent by a coder can no longer proceed in the same format. Transcoding converts the frame to another format compatible with the remainder of the transmission system. The most elementary solution (and therefore that in most widespread use at present) is to place a decoder and a coder back to back. The compressed frame arrives with a first format and is decompressed. The decompressed signal is then compressed with a second format accepted by the remainder of the communications system. Such a cascade of a decoder and a coder is referred to as "tandem". That solution is very costly in terms of complexity (essentially because of the recoding) and degrades quality because the second coding is effected on a decoded signal, which is a degraded version of the original signal. Moreover, a frame may encounter several tandems before reaching its destination. The calculation cost and the loss of quality are not difficult to imagine. Moreover, the delays linked to each tandem operation are cumulative and can compromise the interactivity of calls.

What is more, complexity also causes problems in a multiformat compression system in which the same content is compressed to more than one format. This is the case of content servers that broadcast the same content in a plurality of formats adapted to the access conditions, networks and terminals of different customers. This multicoding operation becomes extremely complex as the number of formats required increases, which rapidly saturates the resources of the system.

Another case of multiple coding in parallel is a posteriori decision multimode compression. A plurality of compression modes are applied to each segment of the signal to be coded, and that which optimizes a given criterion or achieves the best bit rate/distortion trade-off is selected. Once again, the complexity of each of the compression modes limits the number thereof and/or leads to an a priori selection of a very small number of modes.

Prior art approaches to solving the above problems are described below.

New multimedia communications applications (such as audio and video applications) often necessitate a plurality of coding operations either in cascade (transcoding) or in parallel (multicoding and a posteriori decision multimode coding). The problem of the complexity barrier resulting from all these coding operations remains to be solved, despite the increase in current processing powers. Most prior art multiple coding operations do not take account of interactions between formats and between the format of the coder E and its content. Nevertheless, a few intelligent transcoding techniques have been proposed that are not satisfied merely by decoding and then recoding, but instead exploit the similarities between coding formats so that complexity can be reduced whilst limiting the resulting degradation.

So-called "intelligent" transcoding methods are described below.

All the coders in the same family of coders (CELP, parametric, transform, etc.) extract the same physical parameters from the signal. There is nevertheless great variety in terms of modeling and/or quantizing those parameters. Thus the same parameter may be coded in the same way or very differently from one coder to another.

Moreover, the coding may be strictly identical, or it may be identical in terms of modeling and calculation of the parameter, but differ simply in how the coding is translated into the form of bits. Finally, the coding may be completely different in terms of modeling and quantizing the parameter, or even in terms of its analysis or sampling frequency.

If modeling and parameter calculation are strictly identical, including translation to bit form, it suffices to copy the corresponding bit field from the bit stream generated by the first coder to that of the second. This highly favorable situation arises on transcoding from the G.729 standard to the IS-641 standard for adaptive excitation (LTP delays), for example.

If, for the same parameter, the two coders differ only in terms of the translation of the calculated parameter into bit form, it suffices to decode the bit field of the first format and then to return it to the binary domain using the coding method of the second format. This conversion may also be effected by means of one-to-one correspondence tables. This is the situation when transcoding fixed excitations from the G.729 standard to the AMR standard (7.4 kbps and 7.95 kbps modes), for example.

In the above two situations, transcoding the parameter remains at the bit level. Simple bit manipulation renders the parameter compatible with the second coding format. On the other hand, if a parameter extracted from the signal is modeled or quantized differently by two coding formats, passing from one to the other is not such a simple matter. Several methods have been proposed. They operate at the parameter level, the excitation level, or the decoded signal level.

For transcoding in the parameter domain, remaining at the parameter level is possible if the two coding formats calculate a parameter in the same way but quantize it differently. Quantizing differences may be related to the accuracy or the method selected (scalar, vectorial, predictive, etc.). It then suffices to decode the parameter and then to quantize it using the method of the second coding format. That prior art method is used at present for transcoding excitation gains in particular. The decoded parameter must often be modified before it is requantized. For example, if the coders have different parameter analysis frequencies or different frame/subframe lengths, it is standard practice to interpolate/decimate the parameters. Interpolation may be effected by the method described in the published document US2003/033142, for example. Another modification option is to round off the parameter to the accuracy imposed on it by the second coding format. This situation is encountered for the most part for the height of the fundamental frequency ("pitch").

If it is not possible to transcode a parameter within the parameter domain, decoding can go to a higher level. This is the excitation domain, without going so far as the signal domain. This technique has been proposed for gains in the document "Improving transcoding capability of speech coders in clean and frame erasured channel environments", Hong-Goo Kang, Hong Kook Kim, Cox, R. V., Speech Coding, 2000, Proceedings 2000, IEEE Workshop on Speech Coding, Pages 78-80.

Finally, a last solution (the most complex and the least "intelligent") consists in recalculating the parameter explicitly, as the coder would, but based on a synthesized signal. This operation amounts to a kind of partial tandem, with only some parameters being entirely recalculated. This method has been applied to diverse parameters such as the fixed excitation, the gains in the IEEE reference cited above, or the pitch.

For transcoding pulses, although several techniques have been developed to calculate the parameters quickly and at lower cost, few solutions available today use an intelligent approach to calculating the pulses of one format from the equivalent parameter in another format. In coding using analysis by synthesis, intelligent transcoding of pulse codes is applied only if the modeling is identical (or close). In contrast, if the modeling is different, the partial tandem method is used. Note that to limit the complexity of this operation, focused approaches have been proposed that exploit the properties of the decoded signal or a derived signal such as a target-signal. In the document US-2001/027393 cited above, in an embodiment utilizing an MDCT transform coder, there is described a bit rate change procedure that may be considered a special case of intelligent transcoding. That procedure requantizes a vector from a first dictionary using a vector from a second dictionary. To this end it distinguishes between two situations depending on whether the vector to be requantized belongs to the second dictionary or not. If the quantized vector belongs to the new dictionary, the modeling is identical; if not, the partial decoding method is applied.

Setting itself apart from all the above prior art techniques, the present invention proposes a method of multipulse transcoding based on selecting a subset of combinations of pulse positions of an ensemble of sets of pulses from a combination of pulse positions of another ensemble of sets of pulses, the two ensembles being distinguished by the numbers of pulses that they include and by rules governing their positions and/or their amplitudes. This form of transcoding is very beneficial for multiple coding in cascade (transcoding) or in parallel (multicoding and multimode coding) in particular.

SUMMARY OF THE INVENTION

To this end, the present invention firstly proposes a method of transcoding between a first compression codec and a second compression codec. The first and second codecs are of pulse type and use multipulse dictionaries in which each pulse has a position marked by an associated index.

The transcoding method of the invention includes the following steps:

a) where appropriate, adapting coding parameters between said first and second codecs;

b) obtaining from the first codec a selected number of pulse positions and respective position indices associated therewith;

c) for each current pulse position of given index, forming a group of pulse positions including at least the current pulse position and the pulse positions with associated indices immediately below and immediately above the given index;

d) selecting as a function of pulse positions accepted by the second codec at least some of the pulse positions in an ensemble constituted by a union of said groups formed in step c); and e) sending the selected pulse positions to the second codec for coding/decoding from the positions sent.

The selection step d) therefore involves a number of pulse positions that is less than the total number of pulse positions in the dictionary of the second codec.

It is clear in particular that if, in the step e), the second above-mentioned codec is a coder, the selected pulse positions are transmitted to that coder for coding by searching only the positions transmitted. If the second above-mentioned codec is a decoder, the selected pulse positions are transmitted for the positions to be decoded.

The step b) preferably uses partial decoding of the bit stream supplied by the first codec to identify a first number of pulse positions that the first codec uses in a first coding format. The number chosen in the step b) therefore preferably corresponds to this first number of pulse positions.

In an advantageous embodiment, the above steps are executed by a software product including program instructions to that effect. In this regard, the present invention is also directed to a software product of the above kind adapted to be stored in a memory of a processor unit, in particular of a computer or a mobile terminal, or on a removable memory medium adapted to cooperate with a reader of the processor unit.

The present invention is also directed to a device for transcoding between first and second compression codecs, in which case it includes a memory adapted to store instructions of a software product of the type described above.

BRIEF DESCRIPTION OF THE DRAWINGS

Other features and advantages of the invention become apparent on reading the following detailed description and examining the appended drawings, in which.

MORE DETAILED DESCRIPTION

Note first that the present invention relates to modeling and coding digital multimedia signals such as audio (speech and/or sound) signals using multipulse dictionaries. It may be implemented in the context of multiple coding/decoding in cascade or in parallel or of any other system modeling a signal by means of a multipulse representation and which, based on the knowledge of a first set of pulses belonging to a first ensemble, has to determine at least one set of pulses of a second ensemble. For conciseness, only the passage from a first ensemble to another ensemble is described, but the invention applies equally to passage to n ensembles ($n \geqq 2$). Moreover, only the situation of "transcoding" between two coders is described below, but transcoding between a coder and a decoder can of course be deduced from this without major difficulty.

Figure 1A:
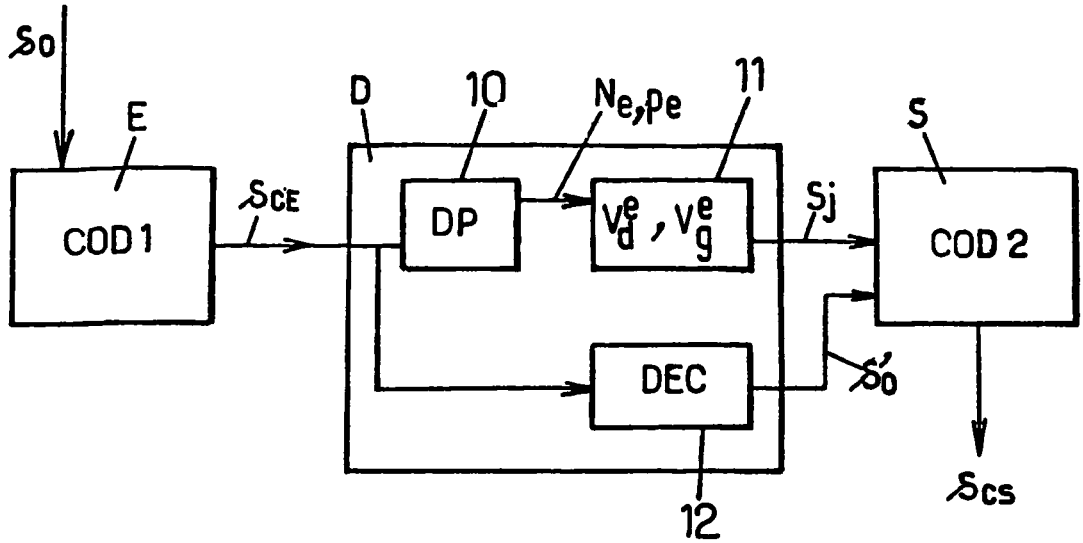
FIG. 1*a* is a diagram of a transcoding context in the terms of the present invention in a "cascade" configuration.
Figure 1B:
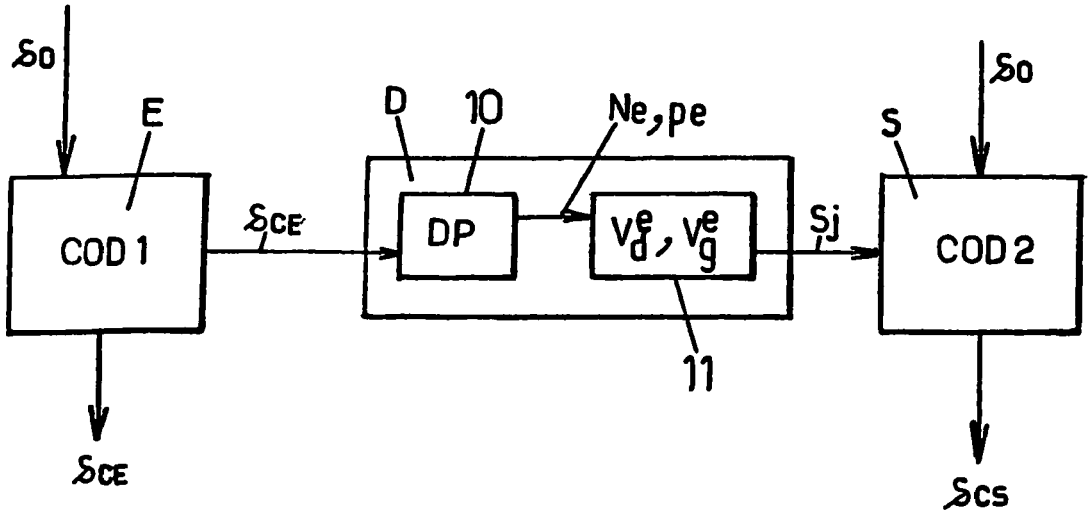
FIG. 1*b* is a diagram of a transcoding context in the terms of the present invention in a "parallel" configuration.

Consider the case therefore of modeling a signal by sets of pulses corresponding to two coding systems. FIGS. 1*a* and 1*b* represent a transcoder D between a first coder E using a first coding format COD1 and a second coder S using a second coding format COD2. The coder E delivers a coded bit stream SCE in the form of a succession of coded frames to the transcoder D, which includes a partial decoder module 10 for recovering the number $N_e$ of pulse positions used in the first coding format and the positions $p_e$ of those pulses. As emerges in detail below, the transcoder of the invention extracts the right-hand neighbor $v^e_d$ and the left-hand neighbor $v^e_g$ of each pulse position $p_e$ and selects pulse positions in the union of those neighborhoods that will be recognized by the second coder S. The module 11 of the transcoder represented in FIGS. 1*a* and 1*b* therefore performs these steps to deliver this selection of positions (denoted $S_j$ in FIGS. 1*a* and 1*b*) to the second coder S. It will be clear in particular that from this selection $S_j$ there is constituted a subdirectory smaller than the dictionary usually employed by the second coder S, which is one of the advantages of the invention. Using this subdirectory, the coding effected by the coder S is of course faster, because it is more restricted, but without this degrading coding quality.

In the example represented in FIG. 1*a*, the transcoder D further includes a module 12 for at least partly decoding the coded stream SCE that the first coder E delivers. The module 12 then supplies to the second coder S an at least partly decoded version $s'_0$ of the original signal $s_0$. The second coder S then delivers a coded bit stream $s_{CS}$ based on that version $s'_0$.

In this configuration, the transcoder D therefore effects coding adaptation between the first coder E and the second coder S, advantageously favoring faster (because more restricted) coding by the second coder S. Of course, as an alternative to this, the entity referenced S in FIGS. 1*a* and 1*b* may be a decoder and, in this variant, the transcoder D of the invention effects transcoding proper between a coder E and a decoder S, this decoding being fast because of the information supplied by the transcoder D. Since the process is reversible, it is clear that, much more generally, the transcoder D in the sense of the present invention operates between a first codec E and a second codec S.

Note that the arrangement of the coder E, the transcoder D and the coder S may conform to a "cascade" configuration as represented in FIG. 1*a*. In the variant represented in FIG. 1*b*, this arrangement may conform to a "parallel" configuration. In this case, the two coders E and S receive the original signal $s_0$ and the two coders E and S deliver the coded streams $S_{CE}$ and $s_{CS}$, respectively. Of course, here the second coder S no longer has to receive the version $s'_0$ from FIG. 1*a* and the module 12 of the transcoder D for at least partial decoding is no longer necessary. Note further that, if the coder E can provide an output compatible with the input of the module 11 (number of pulses and pulse positions), the module 10 may simply be omitted or "bypassed".

Note further that the transcoder D may simply be equipped with a memory for storing instructions for implementing the foregoing steps and a processor for processing those instructions.

The invention is therefore applied as follows. The first coder E has effected its coding operation on a given signal $s_0$ (for example the original signal). The positions of the pulses selected by the first coder E are therefore available. That coder determined these positions $P_e$ using a technique of its own during the coding process. The second coder S must also perform its coding. In the case of transcoding, the second coder S has only the bit stream generated by the first coder and the invention is here applicable to "intelligent" transcoding as defined above. In the case of multiple coding in parallel, the second coder S also has the signal that the first coder has and here the invention applies to "intelligent multicoding". A system that requires to code the same content in a plurality of formats can exploit the information of a first format to simplify coding the other formats. The invention can also be applied to the particular situation of multiple coding in parallel constituting a posteriori decision multimode coding.

The present invention can be used to determine quickly the positions $p_s$ (interchangeably denoted $s_i$ below) of the pulses for another coding format from positions $p_e$ (interchangeably denoted $e_i$ below) of the pulses of a first format. It considerably reduces the calculation complexity of this operation for the second coder by limiting the number of possible positions. To this end, it uses the positions selected by the first coder to define a restricted set of positions from all possible positions of the second coder, in which restricted set the best set of positions for the pulses is searched for. This results in a significant increase in complexity whilst limiting degradation of the signal relative to a standard exhaustive or focused search.

It is therefore clear that the present invention limits the number of possible positions by defining a restricted set of positions based on positions from the first coding format. It differs from existing solutions in that they use only the properties of the signal to be modeled to limit the number of possible positions, by giving preference to and/or eliminating positions.

For each pulse of a set of a first ensemble, two neighbors (one on the right and one on the left) of variable width and of greater or lesser constraint are preferably defined and an ensemble of possible positions extracted therefrom within which at least one combination of pulses complying with the constraints of the second ensemble will be preselected.

The transcoding method has the advantage of optimizing the complexity/quality trade-off by adapting the number of pulse positions and/or the respective sizes (in terms of combinations of pulse positions) of the right-hand and left-hand neighborhoods for each pulse, either at the beginning of the processing or for each subframe as a function of the authorized complexity and/or the set of starting positions. The invention also adjusts/limits the number of combinations of positions by advantageously favoring the immediate neighborhoods.

As indicated above, the present invention is also directed to a software product the algorithm whereof is designed in particular to extract neighbor positions that facilitate composing the combinations of pulses of the second ensemble.

As indicated above, the heterogeneous nature of the networks and the contents may call highly varied coding formats into play. Coders may be distinguished by numerous characteristics, of which two in particular, the sampling frequency and the duration of a subframe, substantially determine the mode of operation of the invention. The options are described below in corresponding relationship to embodiments of the invention suited to these situations.

Figure 2:
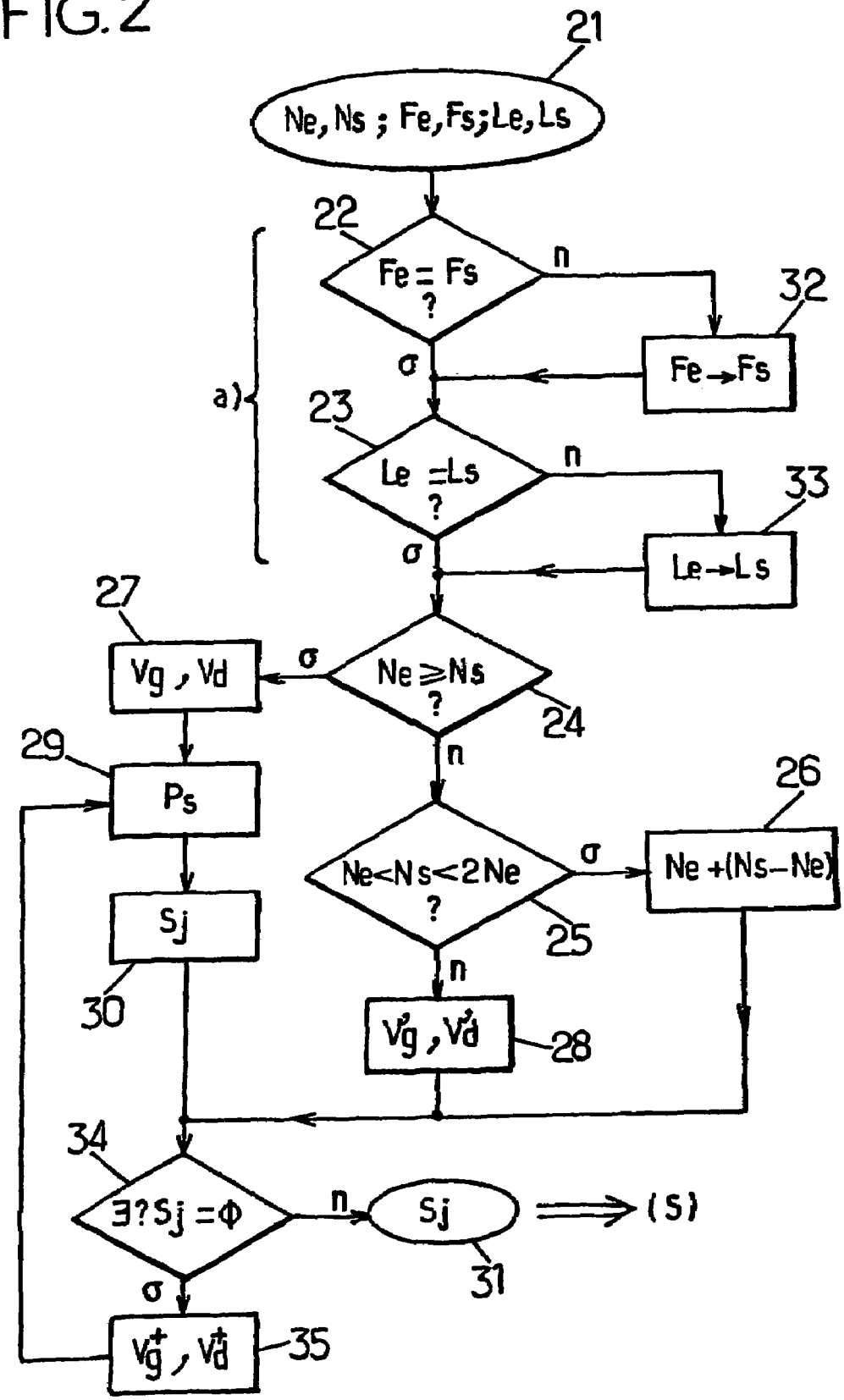
FIG. 2 is a diagram of the various transcoding processes to be effected.

FIG. 2 summarizes these situations. There are initially obtained:

the numbers $N_e$, $N_s$ of pulse positions, the respective sampling frequencies $F_e$, $F_s$, and the subframe durations $L_e$, $L_s$, used by the coders E and S, respectively (step 21 ). Thus it is already clear that steps of adaptation and of recovering the numbers $N_e$, $N_s$ of pulse positions may advantageously be interchanged or simply conducted simultaneously.

The sampling frequencies are compared in a test 22. If the frequencies are equal, the subframe durations are compared in a test 23. If not, the sampling frequencies are adapted in a step 32 by a method described below. Following the test 23, if the subframe durations are equal, the numbers $N_e$ and $N_s$ of pulse positions used by the first and second coding formats, respectively, are compared in a test 24. If not, the subframe durations are adapted in a step 33 using a method that is also described below. It is clear that the steps 22, 23, 32 and 33 together define the above step a) of adapting the coding parameters. Note that the steps 22 and 32 (sampling frequency adaptation), on the one hand, and the steps 23 and 33 (subframe duration adaptation), on the other hand, may be interchanged.

There is first described below a situation in which the sampling frequencies are equal and the subframe durations are equal.

This is the most favorable situation, but it is nevertheless necessary to distinguish the situation in which the first format uses more pulses than the second ($N_e \geqq N_s$) and the contrary situation ($N_e < N_s$), according to the result of the test 24.

$N_e \geqq N_s$ in FIG. 2

The principle is as follows. The directories of the two coders E and S use $N_e$ and $N_s$ pulses in each subframe, respectively.

The coder E calculates the positions of its $N_e$ pulses over the subframe $s_e$. These positions are interchangeably denoted $e_i$ and $p_e$ below. The restricted ensemble $P_s$ of privileged positions for the pulses of the directory of the coder S is then made up of $N_e$ positions $e_i$ and their neighborhoods:

$$P_s = \bigcup_{i=0}^{N_e-1} \left\{ \bigcup_{k=-v_g^i}^{v_d^i} \{e_i + k\} \right\}$$

where $v_d^i$ and $v_g^i \geqq 0$ are the sizes of the right-hand and left-hand neighborhoods of the pulse i. The values of $v_d^i$ and $v_g^i$, which are chosen in the step 27 in FIG. 2, are larger or smaller according to the complexity and quality required. These sizes may be fixed arbitrarily at the beginning of processing or chosen for each subframe $s_e$.

In step 29 in FIG. 2, the ensemble $P_s$ then contains each position $e_i$ as well as its right-hand neighbors $v_d^i$ and its left-hand neighbors $v_g^i$.

It is then necessary to define for each of the $N_s$ pulses from the directory of the coder S the positions which that pulse is authorized to assume among those proposed by $P_s$.

To this end, rules governing the construction of the directory of S are introduced. It is assumed that the $N_s$ pulses of S belong to predefined subsets of positions, a given number of pulses sharing the same sub-set of authorized positions. For example, the 10 pulses of the 12.2 kbps mode 3GPP NB-AMR coder are distributed two by two into five different subsets, as shown in Table 3 above. $N'_s$ denotes the number of subsets of different positions ($N'_s \leqq N_s$ in this example since $N'_s=5$) and $T_j$ (for j=1 to $N'_s$) denotes the subsets of positions defining the directory of S.

Starting from the ensemble $P_s$, the $N'_s$, subsets $S_j$ resulting from the intersection of $P_s$ with one of the ensembles $T_j$ are constituted in step 30 in FIG. 2 from the equation:

$$S_j = P_s \cap T_j$$

The neighborhoods $v_d^i$ and $v_g^i$ must be of sufficient size for no intersection to be empty. It is therefore necessary to allow adjustment of the neighborhood sizes, if necessary, as a function of the starting set of pulses. This is the purpose of the test 34 in FIG. 2, with an increase in the size of the neighborhoods (step 35) and a return to the definition of the union $P_s$ of the groups formed in the step c) (step 29 in FIG. 2) if one of the intersections is empty. On the other hand, if none of the intersections $S_j$ is empty, it is the subdirectory consisting of those intersections $S_j$ that is sent to the coder S (end step 31).

The invention advantageously exploits the structure of the directories. For example, if the directory of the coder S is of the ACELP type, it is the intersections of the positions of the tracks with $P_s$ that are calculated. If the directory of the coder E is also of the ACELP type, the neighborhood extraction procedure also exploits the track structure and the steps of extracting the neighborhoods and composing restricted subsets of positions are judiciously combined. In particular, it is beneficial for the neighborhood extraction algorithm to take account of the composition of the combinations of pulses in accordance with the constraints of the second ensemble. As will emerge later, neighborhood extraction algorithms are produced to facilitate the composition of combinations of pulses of the second ensemble. One of the embodiments described later (from ACELP with two pulses to ACELP with four pulses) is an example of this kind of algorithm.

The number of possible combinations of positions is therefore small and the size of the subset of the directory of the coder S is generally very much less than that of the original directory, which greatly reduces the complexity of the penultimate transcoding step. The number of combinations of pulse positions defines the size of the aforementioned subset. It is the number of pulse positions the invention reduces, which leads to a reduction in the number of combinations of pulse positions and thus makes it possible to obtain a subdirectory of restricted size.

Figure 3:
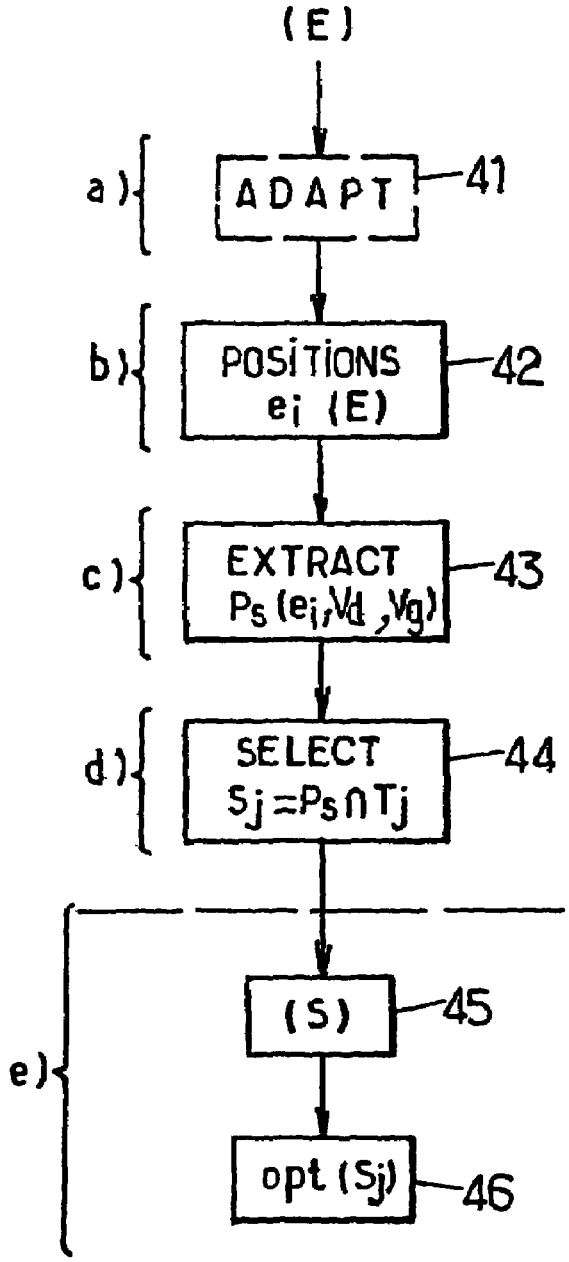
FIG. 3 summarizes the steps of the transcoding method of the invention.

Step 46 in FIG. 3 then consists in launching the search for the best set of positions for the $N_s$ pulses in that subdirectory of restricted size. The selection criterion is similar to that of the coding process. To reduce complexity further, exploration of this subdirectory can be accelerated using the prior art focusing techniques described above.

FIG. 3 summarizes the steps of the invention for a situation in which the coder E uses at least as many pulses as the coder S. However, as already pointed out with reference to FIG. 2, if the number $N_s$ of positions to the second format (the format of S) is greater than the number $N_e$ of positions to the first format (the format of E), the processing differs only in a few advantageous variants that are described later.

In outline, the FIG. 3 steps are summarized as follows. After a step a) of adapting the coding parameters (present only if necessary and therefore represented in dashed outline in the block 41 in FIG. 3):

recovering the positions $e_i$ of the pulses of the coder E, and preferably a number $N_e$ of positions (step 42 corresponding to the above-mentioned step b)), extracting the neighborhoods and forming groups of neighborhoods in accordance with the equation:

$$P_s = \bigcup_{i=0}^{N_e-1} \left\{ \bigcup_{k=-v_g^i}^{v_d^i} \{e_i + k\} \right\}$$

(step 43 corresponding to the above-mentioned step c)), composing restricted subsets $\{S_j = P_s \cap T_j\}$ of positions forming the selection of the above-mentioned step d) and corresponding to the step 44 represented in FIG. 3, and forwarding that selection to the coder S (step 45 corresponding to the above-mentioned step e)). After this step 45, the coder S then chooses a set of positions in the restricted directory obtained in the step 44.

The next step is therefore a step 46 of searching the subdirectory received by the coder S for a set (opt($S_j$)) of optimum positions including the second number $N_s$ of positions, as indicated above. To accelerate the exploration of the subdirectory, this step 46 of searching for the optimum set of positions is preferably implemented by means of a focused search. Processing continues naturally with the coding that is effected thereafter by the second coder S.

There are described next the forms of processing provided for the situation in which the number $N_e$ of pulses used by the first coding format is lower than the number $N_s$ of pulses used by the second coding format.

$N_e<N_s$ in FIG. 2

If the format of S uses more pulses than the format of E, the process is similar to that explained above. However, pulses of the format of S may not have positions in the restricted directory. In this case, in a first embodiment, all possible positions are authorized for those pulses. In a second and preferred embodiment the sizes of the neighborhoods $V'_d$ and $V'_g$ are simply increased in step 28 in FIG. 2.

$N_e<N_s<2N_e$ in FIG. 2

A special case must be emphasized here. If $N_e$ is close to $N_s$, typically if $N_e<N_s<2N_e$, then a preferred way to determine the positions may be envisaged, even though the above form of processing remains entirely applicable. A further reduction in complexity may be obtained by directly fixing the positions of the pulses of S on the basis of those of E. The $N_e$ first pulses of S are placed at the positions of those of E. The remaining $N_s-N_e$ pulses are placed as close as possible the first $N_e$ pulses (in their immediate neighborhood). Step 25 in FIG. 2 then tests if the numbers $N_e$ and $N_s$ are close (with $N_e>N_s$) and, if so, the choice of the pulse positions in step 26 is as described above.

Of course, in both cases, $N_e<N_s$ and $N_e<N_s<2N_e$, if one of the intersections $S_j$ is empty despite the above precautions, the size of the neighborhoods $V^+_g$, $V^+_d$, is simply increased in step 35, as described in the situation where $N_e \geqq N_s$.

Finally, in all cases, if none of the intersections $S_j$ is empty, the subdirectory formed by the intersections $S_j$ is forwarded to the second coder S (step 31).

There are described next the forms of processing used in the adaptation step a) if the coding parameters of the first and second formats are not the same, in particular their sampling frequencies and subframe durations.

The following situations are then distinguished.

Equal Subframe Durations but Different Sampling Frequencies

This situation corresponds to "n" for the test 22 and "y" for the test 23 in FIG. 2. The adaptation step a) then applies to step 32 in FIG. 2.

The previous processing cannot be applied directly here because the two formats do not have the same time subdivision. Because the sampling frequencies are different, the two frames do not have the same number of samples over the same duration.

Rather that determining the positions of the pulses of the format of the coder S without taking account of those of the format of the coder E, as a tandem would do, two different forms of processing constituting two different embodiments are proposed here. They limit complexity by establishing a correspondence between the positions of the two formats, after which the processing reverts to the processing described above (as if the sampling frequencies were equal).

The processing of the first embodiment uses direct quantization of the time scale of the first format by that of the second format. This quantizing operation, which may be tabulated or computed from a formula, finds for each position of a subframe of the first format its equivalent in a subframe of the second format, and vice-versa.

For example, the correspondence between the positions $p_e$ and $p_s$ in the subframes of the two formats may be defined by the following equation:

$$p_s \left\lfloor \frac{F_s}{F_e} * p_e + 0.5 \right\rfloor, \quad 0 \le p_e < L_e \text{ and } 0 \le p_s < L_s$$

in which $F_e$ and $F_s$ are the sampling frequencies of E and S, respectively, $L_e$ and $L_s$ are their subframe lengths, and $\lfloor\ \rfloor$ denotes the integer part.

Depending on the characteristics of the processor unit, this correspondence could use the above formula or advantageously be tabulated for the $L_e$ values. An intermediate solution may also be selected by tabulating only the first $l_e$ values $$(l_e = \frac{L_e}{d}, d$$

being the highest common factor of $L_e$ and $L_s$), the remaining positions then being easily deduced.

Note that it is also possible to make a plurality of positions of the subframe of S correspond to a position of a subframe of E. For example, retaining the positions immediately below and immediately above $$\frac{F_s}{F_e} * p_e.$$

The general processing described above is applied starting from the ensemble of positions $p_s$ corresponding to the positions $p_e$, (extraction of neighborhoods, composition of combinations of pulses, selection of the optimum combination).

This situation of equal subframe durations but different sampling frequencies is found in Tables 5a to 5d below, referring to an embodiment in which the coder E is of the 3GPP NB-AMR type and the coder S is of the WB-AMR type. The NB-AMR coder has a subframe of 40 samples for a sampling frequency of 8 kHz. The WB-AMR coder uses 64 samples per subframe at 12.8 kHz. In both cases, the subframe has a duration of 5 ms. Table 5a gives the correspondence of the positions in a NB-AMR subframe to a WB-AMR subframe and Table 5b gives the converse correspondence. Tables 5c and 5d are the restricted correspondence tables.

TABLE 5a

NB-AMR to WB-AMR time correspondence table

| | | | | | | | | | | | | | | | | | | | | |
|---|---|---|---|---|---|---|---|---|---|---|---|---|---|---|---|---|---|---|---|---|
| NB-AMR | 0 | 1 | 2 | 3 | 4 | 5 | 6 | 7 | 8 | 9 | 10 | 11 | 12 | 13 | 14 | 15 | 16 | 17 | 18 | 19 |
| WB-AMR | 0 | 2 | 3 | 5 | 6 | 8 | 10 | 11 | 13 | 14 | 16 | 18 | 19 | 21 | 22 | 24 | 26 | 27 | 29 | 30 |
| NB-AMR | 20 | 21 | 22 | 23 | 24 | 25 | 26 | 27 | 28 | 29 | 30 | 31 | 32 | 33 | 34 | 35 | 36 | 37 | 42 | 39 |
| WB-AMR | 32 | 34 | 35 | 37 | 38 | 40 | 42 | 43 | 45 | 46 | 48 | 50 | 51 | 53 | 54 | 56 | 58 | 59 | 61 | 62 |

TABLE 5b

WB-AMR to NB-AMR time correspondence table

| | | | | | | | | | | | | | | | | | | |
|---|---|---|---|---|---|---|---|---|---|---|---|---|---|---|---|---|---|---|
| WB-AMR | 0 | 1 | 2 | 3 | 4 | 5 | 6 | 7 | 8 | 9 | 10 | 11 | 12 | 13 | 14 | 15 | 16 | 17 |
| NB-AMR | 0 | 1 | 1 | 2 | 3 | 3 | 4 | 4 | 5 | 6 | 6 | 7 | 8 | 8 | 9 | 9 | 10 | 11 |
| WB-AMR | 32 | 33 | 34 | 35 | 36 | 37 | 38 | 39 | 40 | 41 | 42 | 43 | 44 | 45 | 46 | 47 | 48 | 49 |
| NB-AMR | 20 | 21 | 21 | 22 | 23 | 23 | 24 | 24 | 25 | 26 | 26 | 27 | 28 | 28 | 29 | 29 | 30 | 31 |
| WB-AMR | 18 | 19 | 20 | 21 | 22 | 23 | 24 | 25 | 26 | 27 | 28 | 29 | 30 | 31 | | | | |
| NB-AMR | 11 | 12 | 13 | 13 | 14 | 14 | 15 | 16 | 16 | 17 | 18 | 18 | 19 | 19 | | | | |
| WB-AMR | 50 | 51 | 52 | 53 | 54 | 55 | 56 | 57 | 58 | 59 | 60 | 61 | 62 | 63 | | | | |
| NB-AMR | 31 | 32 | 33 | 33 | 34 | 34 | 35 | 36 | 36 | 37 | 38 | 38 | 39 | 39 | | | | |

TABLE 5c

NB-AMR to WB-AMR restricted time correspondence table

| | | | | | |
|---|---|---|---|---|---|
| NB-AMR positions | 0 | 1 | 2 | 3 | 4 |
| NB-AMR positions | 0 | 2 | 3 | 5 | 6 |

TABLE 5d

WB-AMR to NB-AMR restricted time correspondence table

| | | | | | | | | |
|---|---|---|---|---|---|---|---|---|
| WB-AMR positions | 0 | 1 | 2 | 3 | 4 | 5 | 6 | 7 |
| NB-AMR positions | 0 | 1 | 1 | 2 | 2 | 3 | 4 | 4 |

Figure 2A:
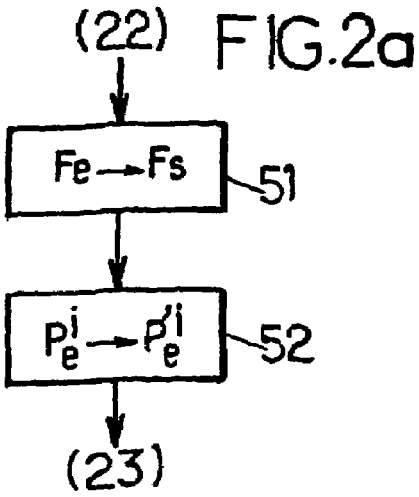
FIG. 2*a* is a diagram of an adaptation process for use when the sampling frequencies of the first coder E and the second coder S are different.

Briefly, the following steps apply (see FIG. 2*a*):

a1) direct timescale quantization from the first frequency to the second frequency (step 51 in FIG. 2*a*), a2) as a function of that quantization, determination of each pulse position in a subframe with the second coding format characterized by the second sampling frequency from a pulse position in a subframe with the first coding format characterized by the first sampling frequency (step 52 in FIG. 2*a*).

In general terms, the quantization step a1) is effected by calculation and/or tabulation from a function which makes correspond to a pulse position $p_e$ in a subframe with the first format a pulse position $p_s$ in a subframe with the second format; that function actually takes the form of a linear combination involving a multiplier coefficient corresponding to the ratio of the second sampling frequency to the first sampling frequency.

Moreover, to go in the opposite direction from a pulse position in a subframe with the second format $p_s$ to a pulse position in a subframe with the first format $p_e$, there is of course applied an inverse function of this linear combination applied to a pulse position in a subframe with the second format $p_s$.

Clearly the transcoding process is completely reversible and is as equally adapted to one transcoding direction (E->S) as to the other (S->E).

A second embodiment of sampling frequency adaptation uses a conventional change of sampling frequency principle. Starting from the subframe containing the pulses found by the first format, oversampling is applied at the frequency equal to the lowest common multiple of the two sampling frequencies $F_e$ and $F_s$. Then, after low-pass filtering, undersampling is applied to revert to the sampling frequency of the second format, i.e. $F_s$. There is obtained a subframe at the frequency $F_s$ containing the filtered pulses from E. Once again, the result of the oversampling/LP filtering/undersampling operations can be tabulated for each possible position of a subframe of E. This processing can also be effected by "on line" calculation. As in the first embodiment of sampling frequency adaptation, one or more positions of S may be associated with a position of E, as explained below, and the general processing in the sense of the above-described invention applied.

Figure 2B:
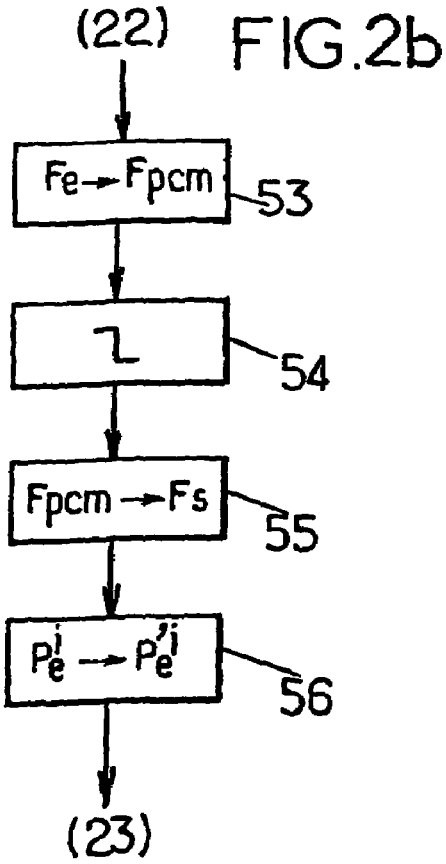
FIG. 2*b* is a diagram of a variant of the FIG. 2*a* process.

As indicated in the variant represented in FIG. 2*b*, the following steps apply:

a'1) oversampling a subframe with the first coding format characterized by the first sampling frequency at a frequency $F_{pcm}$ equal to the lowest common multiple of the first and second sampling frequencies (step 53 in FIG. 2*b*), and a'2) applying low-pass filtering to the oversampled subframe (step 54 in FIG. 2*b*), followed by undersampling to achieve a sampling frequency corresponding to the second sampling frequency (step 55 in FIG. 2*b*).

The process continues by obtaining, preferably by a thresholding method, a number of positions, possibly a variable number of positions, adapted from the pulses of E (step 56), as in the above first embodiment.

Equal Sampling Frequencies but Different Subframe Durations

The processing carried out in the situation where the sampling frequencies are equal but the subframe durations are different is described next. This situation corresponds to "n" for the test 23 but "o" for the test 22 of FIG. 2. The adaptation step a) then applies to the step 33 in FIG. 2.

Figure 4:
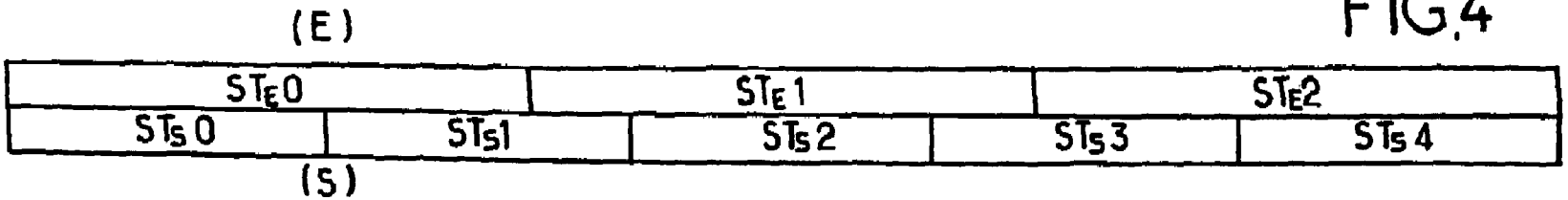
FIG. 4 is a diagram of two subframes of the coders E and S with different durations $L_e$ and $L_s$, respectively, where $L_e > L_s$, but with the same sampling frequencies.

As in the above situation, the neighborhood extraction step as such cannot be applied directly. It is first necessary to make the two subframes compatible. Here the subframes differ in size. Faced with this incompatibility, rather than calculate the positions of the pulses like the tandem does, a preferred embodiment offers a solution of low complexity that determines a restricted directory of combinations of positions for the pulses of the second format from the positions of the pulses of the first format. However, the subframe of S and that of E not being the same size, it is not possible to establish a direct temporal correspondence between a subframe of S and a subframe of E. As shown in FIG. 4 (in which the subframes of E and S are designated $ST_E$ and $ST_S$, respectively), the boundaries of the subframes of the two formats are not aligned and over time the subframes shift relative to each other.

Figure 5:
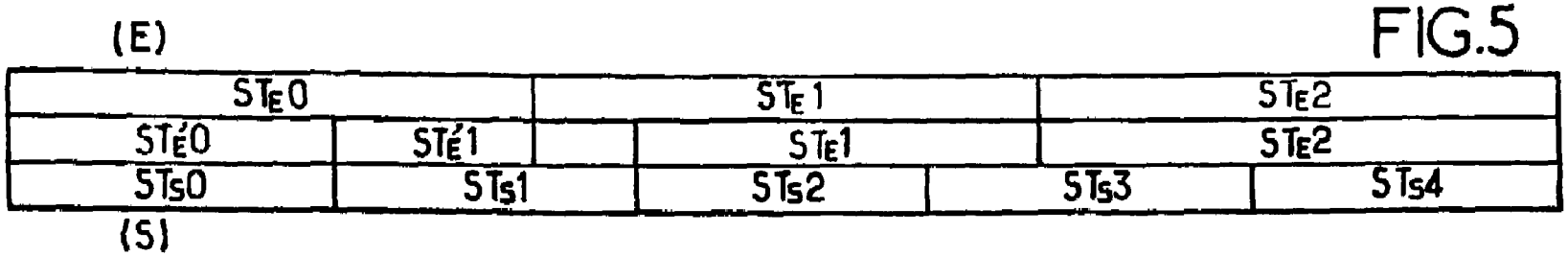
FIG. 5 is a diagram showing division of the excitation of the first coder E at the rate of the second coder S.

In a preferred embodiment, it is proposed to divide the excitation of E into pseudosubframes the size of those of S and at the timing rate of S. The pseudosubframes are denoted $ST_E'$ in FIG. 5. In practice, this amounts to establishing a temporal correspondence between the positions in the two formats taking account of the subframe size difference to align the positions relative to an origin common to E and S. The determination of that common origin is described in detail later.

A position $p^o_e$ (respectively $p^o_s$) of the first format (respectively the second format) relative to that origin coincides with the position $p_e$ (respectively $p_s$) of the subframe $i_e$ (respectively $j_s$) of E (respectively S) relative to that subframe. Thus:

$$p^o_e = p_e + i_e L_e \text{ and } p^o = p_s + j_s L_s \text{ with } 0 \leqq p_e < L_e \text{ and } 0 \leqq p_s < L_s$$

To a position $p_e$ of the subframe $i_e$ of the format of E there corresponds the position $p_s$ of the subframe $j_s$ of the format of S, $p_s$ and $j_s$ being respectively the remainder and the quotient of the Euclidian division by $L_s$ of the position $p^o_e$ of $p_e$ relative to an origin O common to E and S:

$$j_s = \lfloor (p_e + i_e L_e)/L_s \rfloor \text{ and } p_s \equiv (p_e + i_e L_e)[L_s]$$

with $0 < p_e \leqq L_e$ and $0 \leqq p_s < L_s$ $\lfloor\ \rfloor$ denoting the integer part, $\equiv$ denoting the modulus, the index of a subframe of E (respectively S) being given relative to the common origin O.

Figure 6:
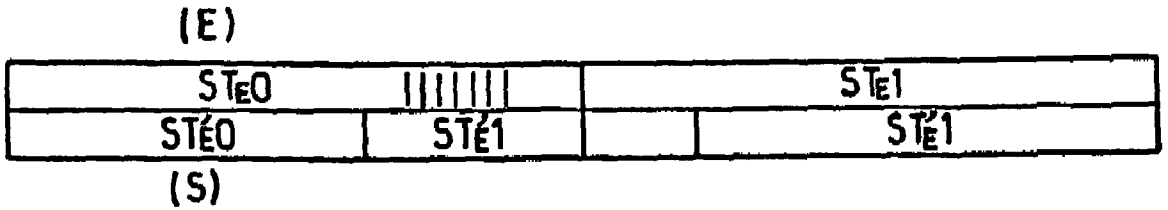
FIG. 6 shows a situation in which one of the pseudosubframes STE'0 is empty.

Accordingly, the positions $p_e$ in a subframe $j_s$ are used to determine a restricted ensemble of positions for pulses of S in the subframe $j_s$ by means of the general process described above. However, if $L_e > L_s$, a subframe of S may not contain any pulse. In the FIG. 6 example, the pulses of the subframe STE0 are represented by vertical lines. The format of E may very well concentrate the pulses of STE0 at the end of the subframe, in which case the pseudosubframe STE'0 does not contain any pulse. All the pulses placed by E are found in STE'1 upon division. In this case, a conventional focused search is preferably applied to the pseudosubframe STE'0.

Preferred embodiments for the determination of a time origin O common to the two formats are described next. That common reference constitutes the position (number 0) from which the positions of the pulses are numbered in the subsequent subframes. This position 0 can be defined in various ways, depending on the system utilizing the transcoding method of the present invention. For example, for a transcoder module included in a transmission system equipment, it will be natural to take for the origin the first position of the first frame received after the equipment is started up.

However, the disadvantage of that choice is that the positions take increasingly large values and it may become necessary to limit them. For this it suffices to update the position of the common origin whenever possible. Accordingly, if the respective lengths $L_e$ and $L_s$, of the subframes of E and S are constant over time, the position of the common origin is reset each time that the boundaries of the subframes of E and S are aligned. This occurs periodically, the period (expressed in samples) being equal to the lowest common multiple of $L_e$ and $L_s$.

The situation may also be envisaged in which $L_e$ and/or $L_s$ are not constant in time. It is no longer possible to find a multiple common to the two subframe lengths, at present denoted $L_e(n)$ and $L_s(n)$, where n represents the subframe number. In this case, it is necessary to sum the values $L_e(n)$ and $L_s(n)$ on the fly and to compare the two sums obtained in each subframe:

$$T_e(k) = \sum_{n=1}^{k} L_e(n) \text{ and } T_s(k') = \sum_{n=1}^{k'} L_s(n)$$

Each time that $T_e(k) = T_s(k')$, the common origin is updated (and taken at the position $k \times L_e$ or $k' \times L_s$). The two sums $T_e$ and $T_s$ are preferably reset.

Briefly, and more generally, calling the first (respectively second) subframe duration the subframe duration of the first (respectively second) coding format, the adaptation steps executed when the subframe durations are different are summarized in FIG. 7, and are preferably as follows:

a20) defining an origin O common to subframes with the first and second formats (step 70), a21) dividing the successive subframes with the first coding format characterized by a first subframe duration into pseudosubframes of duration $L'_e$ corresponding to the second subframe duration (step 71), a22) updating of the common origin O (step 79), and a23) determining the correspondence between the pulse positions in the pseudosubframes $p'_e$ and in the subframes with the second format (step 80).

Figure 7:
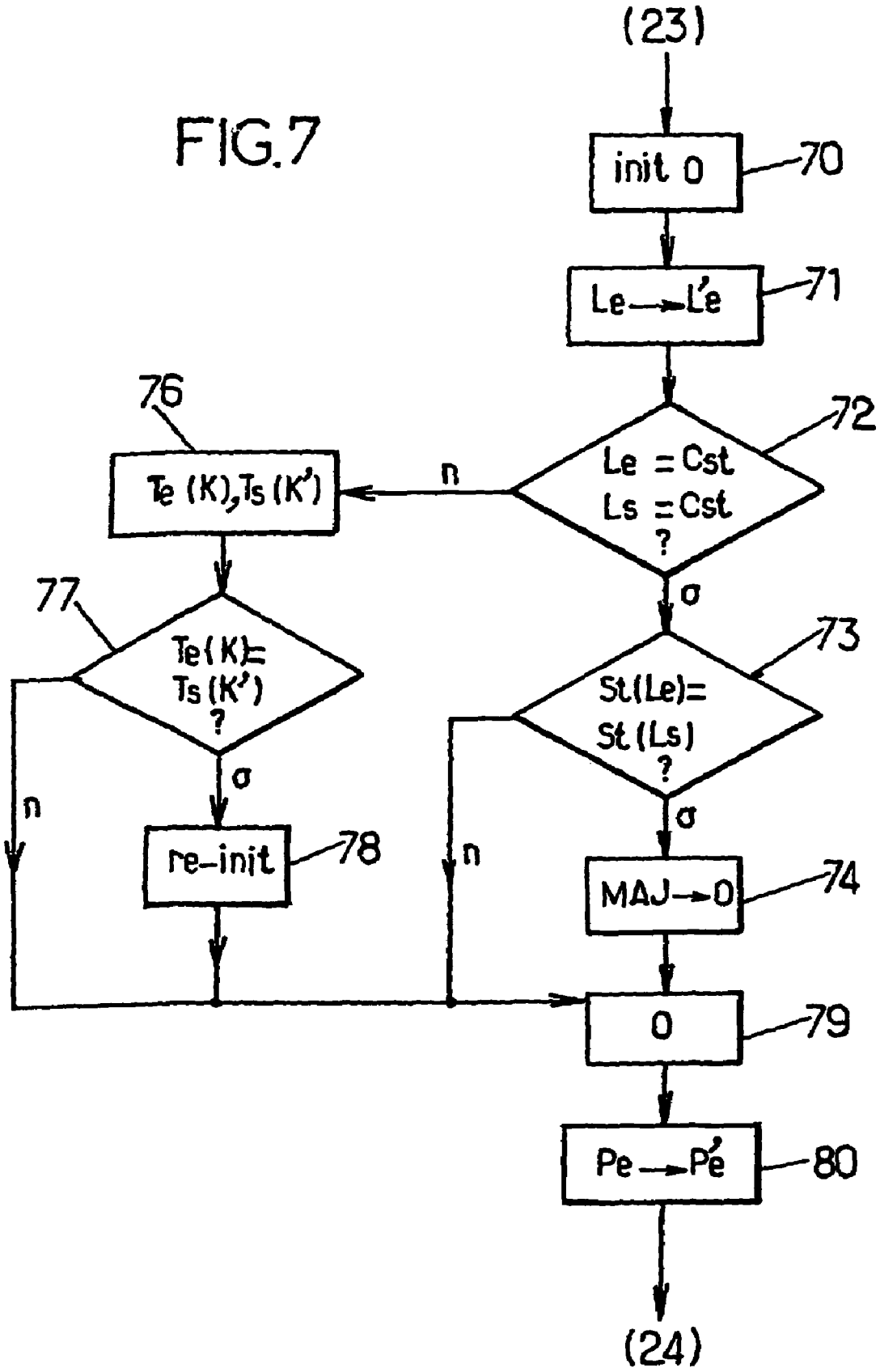
FIG. 7 is a diagram of an adaptation process for use when the subframe durations of the first coder E and the second coder S are different.

To determine the common origin O, the following cases are preferably discriminated in the test 72 in FIG. 7:

the first and second durations are fixed in time ("o" exit from test 72); and the first and second durations vary in time ("n" exit from test 72).

In the former case, the time position of the common origin is updated periodically (step 74), each time that the boundaries of the respective subframes of first duration $St(L_e)$ and second duration $St(L_s)$ are aligned in time (test 73 applied to those boundaries).

In the second case, it is preferable if:

a221) the respective summations of subframes with the first format $T_e(k)$ and subframes with the second format $T_s(k')$ are effected successively (step 76), a222) equality of said two sums is detected, defining a time for updating said common origin (test 77), and a223) the aforesaid two sums are reset (step 78), after said equality is detected, for future detection of a next common origin.

Now, in the situation in which the subframe durations and sampling frequencies are different, it suffices to combine judiciously the algorithms of the correspondences between the positions of E and S described for the above two situations.

Embodiments

Three embodiments of transcoding in accordance with the invention are described next. These embodiments describe the application of the processing provided in the situations described above in standard speech coders using analysis by synthesis. The first two embodiments illustrate the favorable situation in which the sampling frequencies and the subframe durations are identical. The final embodiment illustrates the situation in which the subframe durations are different.

Embodiment No. 1

The first embodiment applies to intelligent transcoding between the 6.3 kbps mode G.723.1 MP-MLQ model and the 5.3 kbps mode G.723.1 ACELP model with four pulses.

Intelligent transcoding from the high bit rate to the low bit rate of G.723.1 employs an MP-MLQ model with six and five pulses with an ACELP model with four pulses. The embodiment described here determines the positions of the four ACELP pulses from the positions of the MP-MLQ pulses.

The operation of the G.723.1 coder is summarized below.

The ITU-T G.723.1 multiple bit rate coder and its multipulse directories have been described above. Suffice to say that a G.723.1 frame contains 240 samples at 8 kHz and is divided into four subframes each of 60 samples. The same restriction is imposed on the positions of the pulses of any code-vector of each of the three multipulse dictionaries. These positions must all have the same parity (they must all be even or all be odd). The subframe of 60(+4) positions is therefore divided into two grids each of 32 positions. The even grid includes the positions numbered [0, 2, 4, . . . , 58, (60,62)]. The odd grid includes the positions [1, 3, 5, . . . , 59, (61,63)]. For each bit rate, exploration of the directory, although not exhaustive, remains complex, as indicated above.

The selection of a subset of the 5.3 kbps mode G.723.1 ACELP directory from an element of a 6.3 kbps mode G.723.1 MP-MLQ directory is described next.

The aim is to model the innovation signal of a subframe by means of an element from the 5.3 kbps mode G.723.1 ACELP directory knowing the element of the 6.3 kbps mode MP-MLQ G.723.1 directory determined during a first coding operation. The $N_e$ positions ($N_e$=5 or 6) of the pulses selected by the 6.3 kbps mode G.723.1 coder are therefore available.

For example, it may be assumed that the positions extracted from the bit stream of the 6.3 kbps mode G.723.1 coder for a subframe whose excitation is modeled by $N_e$=5 pulses are as follows:

$$e_0=0;\ e_1=8;\ e_2=28;\ e_3=38;\ e_4=46;$$

Remember that no adaptation of sampling frequency or subframe duration is required here. After this step of recovering the positions $e_i$, a subsequent step then consists in extracting the right-hand and left-hand neighborhoods of those five pulses directly. The right-hand and left-hand neighborhoods are here taken to be equal to two. The ensemble $P_s$ of positions selected is:

$$P_s=\{-2,-1,0,1,2\}\cup\{6,7,8,9,10\}\cup\{26,27,28,29,30\}\cup\{36,37,38,39,40\}\cup\{44,45,46,47,48\}$$

The third step consists in composing the restricted ensemble of possible positions for each pulse (here one track) of the ACELP directory of the 5.3 kbps mode G.723.1 coder by taking $N_s$=4 intersections of $P_s$ with the four ensembles of positions of the even tracks (respectively odd tracks) authorized by said directory (as represented in Table 1).

For even parity:

$$S_0=P_s\cap\{8,16,\ldots,56\};\ S_1=P_s\cap\{2,10,18,\ldots,58\};\ S_2=P_s\cap\{4,12,20,\ldots,52,(60)\};$$

$$S_3=P_s\cap\{6,14,22,\ldots,54,(62)\};$$

whence : $S_0=\{0,8,40,48\}$; $S_1=\{2,10,26,\}$; $S_2=\{28,36,44\}$; $S_3=\{6,30,38,46\}$;

For odd parity:

$$S_0=P_s109\ \{1,9,\ldots,57\};\ S_1=P_s\cap\{3,11,\ldots,59\};\ S_2=P_s\cap\{5,13,\ldots,53,(61)\};$$

$$S_3=P_s\cap\{7,15,\ldots,55,(63)\};$$

whence : $S_0=\{1,9\}$; $S_1=\{27\}$; $S_2=\{29,37,45\}$; $S_3=\{7,39,47\}$;

The combination of these selected positions constitutes the new restricted directory in which the search will be effected. For this step, the procedure for selecting the set of optimum positions is based on the CELP criterion, as in the 5.3 kbps mode G.723.1 coder. The exploration may be exhaustive but is preferably focused.

The number of combinations of positions in the restricted directory is equal to 180 (=4*3*3*4+2*1*3*3) instead of 8192 (=2*8*8*8*8) combinations of positions of the ACELP directory of the 5.3 kbps mode G.723.1 coder.

The number of combinations may be further restricted by considering only the parity chosen for the 6.3 kbps mode (in the present example that is the even parity). In this case, the number of combinations in the restricted directory is equal to 144.

Depending on the size of the neighborhoods concerned, for one of the four pulses the ensemble $P_s$ may not contain any position for a track of the ACELP model (situation in which one of the ensembles $S_i$ is empty). Accordingly, for neighborhoods of size 2, when the positions of the $N_e$ pulses are all on the same track, $P_S$ contains only positions of that track and adjacent tracks. In this case, depending on the required quality/complexity trade-off, it is possible either to replace the ensemble $S_i$ with $T_i$ (which amounts to not restricting the ensemble of positions of that track) or to increase the right-hand (or left-hand) neighborhood of the pulses. For example, if all the pulses of the 6.3 kbps mode coder are on track 2, with right-hand and left-hand neighborhoods equal to two, then track 0 will have no positions regardless of the parity. It then suffices to increase by 2 the size of the left-hand and/or right-hand neighborhood to assign positions to that track 0.

To illustrate this embodiment, consider the following example:

$$e_0=4;\ e_1=12;\ e_2=20;\ e_3=36;\ e_4=52;$$

The ensemble $P_s$ of selected positions is as follows:

$$P_s=\{2,3,4,5,6\}\cap\{10,11,12,13,14\}\cap\{18,19,20,21,22\}\cap\{34,35,36,37,38\}\cap\{50,51,52,53,54\}$$

Assuming that it is wished to retain the same parity, the initial division of these positions for the four pulses is as follows:

$$S_0=\emptyset;\ S_1=\{2,10,18,34,50\};\ S_2=\{4,12,20,36,52\};$$

$$S_3=\{6,14,22,38,54\}.$$

By increasing by 2 the left-hand neighborhood of the pulses, we obtain:

$$S_0=\{0,8,16,32,48\};\ S_1=\{2,10,18,34,50\};$$

$$S_2=\{4,12,20,36,52\};\ S_3=\{6,14,22,38,54\}$$

(therefore with $S_0\neq\emptyset$).

Embodiment No. 2

The following second embodiment illustrates the application of the invention to intelligent transcoding between ACELP models of the same length. In particular, this second embodiment is applied to intelligent transcoding between the ACELP model with four pulses of 8 kbps mode G.729 and the ACELP with two pulses of 6.4 kbps mode G.729.

Intelligent transcoding between the 6.4 kbps and 8 kbps modes of the G.729 coder utilizes one ACELP directory with two pulses and a second one with four pulses. The embodiment described here determines the positions of four pulses (8 kbps) from the positions of two pulses (6.4 kbps) and vice-versa.

The operation of the ITU-T G.729 encoder is described briefly. This coder can operate at three bit rates: 6.4, 8 and 11.8 kbps. The first two bit rates are considered here. A G.729 frame contains 80 samples at 8 kHz and is divided into two subframes each of 40 samples. For each subframe, G.729 models the innovation signal by means of pulses conforming to the ACELP model. It uses four pulses for the 8 kbps mode and two pulses for the 6.4 kbps mode. Tables 2 and 4 above give the positions that the pulses can adopt for those two bit rates. At 6.4 kbps, an exhaustive search of all (512) combinations of positions is effected. At 8 kbps, a focused search is preferably used.

The general processing in accordance with the invention is used again here. However, the ACELP structure common to the two directories is advantageously exploited here. Establishing the correspondence between the sets of positions therefore exploits a division of the subframe of 40 samples into five tracks each of eight positions, as set out in Table 6 below.

TABLE 6

Division of positions into five tracks in the G.729 ACELP dictionaries

| Track | Positions |
|---|---|
| $P_0$ | 0, 5, 10, 15, 20, 25, 30, 35 |
| $P_1$ | 1, 6, 11, 16, 21, 26, 31, 36 |
| $P_2$ | 2, 7, 12, 17, 22, 27, 32, 37 |
| $P_3$ | 3, 8, 13, 18, 23, 28, 33, 38 |
| $P_4$ | 4, 9, 14, 19, 24, 29, 34, 39 |

In the two directories, the positions of the pulses share these tracks, as shown in Table 7 below.

All the pulses are characterized by the their track and their rank in that track. The 8 kbps mode places a pulse on each of the first three tracks and the last pulse on one of the last two tracks. The 6.4 kbps mode places its first pulse on track $P_1$ or $P_3$ and its second pulse on track $P_0$, $P_1$, $P_2$ or $P_4$.

TABLE 7

Distribution of the pulses of the 8 and 6.4 kbps mode G.729 ACELP directories into five tracks

| Mode | Pulses | Tracks |
|---|---|---|
| 6.4 kbps | $i_0$ | $P_1$, $P_3$ |
| | $i_1$ | $P_0$, $P_1$, $P_2$, $P_4$ |
| 8 kbps | $i_0$ | $P_0$ |
| | $i_1$ | $P_1$ |
| | $i_2$ | $P_2$ |
| | $i_3$ | $P_3$, $P_4$ |

This embodiment exploits interleaving of the tracks (ISSP structure) to facilitate extracting the neighborhoods and composing the restricted subensembles of positions. Accordingly, to move from one track to another, it suffices to shift one unit to the right or to the left. For example, at the $5^{th}$ position of track 2 (absolute position 22), a shift of one unit to the right (+1) goes to the $5^{th}$ position on track 3 (absolute position 23) and a shift of one unit to the left (−1) goes to the $5^{th}$ position of track 1 (absolute position 21).

More generally, a position shift of ±d is reflected here in the following effects.

At the level of the tracks $P_i$:

right-hand neighborhood: $P_i \Rightarrow P_{(i+d)\bmod 5}$ left-hand neighborhood: $P_i \Rightarrow P_{(i-d)\bmod 5}$ At the level of the rank m in the track:

right-hand neighborhood:

if $(I+d)\leqq 4$: $m_i \Rightarrow m_i$ if not: $m_i \Rightarrow m_i+1$ left-hand neighborhood:

if $(I-d)\geqq 0$: $m_i \Rightarrow m_i$ if not $m_i \Rightarrow m_i-1$

The selection of a subensemble of the ACELP directory with four pulses of the 8 kbps mode G.729 coder from an element of an ACELP directory with two pulses of the 6.4 kbps mode G.729 coder is described next.

A 6.4 kbps mode G.729 subframe is considered. Two pulses are placed by the coder, but it is necessary to determine the positions of the other pulses that the 8 kbps mode G.729 must place. To restrict complexity radically, only one position per pulse is selected and only one combination of positions is retained. This has the advantage that the selection step is therefore immediate. Two of the four pulses of the 8 kbps mode G.729 are selected at the same positions as those of the 6.4 kbps mode, after which the remaining two pulses are placed in the immediate neighborhood of the first two. As indicated above, the track structure is exploited. In the first step of recovering the two positions by decoding the binary index (on nine bits) of the two positions, the corresponding two tracks are also determined. From those two tracks (which may be identical), the last three steps of extracting the neighborhoods, composing the restricted subensembles and selecting a combination of pulses are then judiciously associated. Different cases are then distinguished according to the tracks $P_i$ (i=0 to 4) containing the two 6.4 kbps mode pulses.

The positions of the 6.4 kbps mode pulses are denoted $e_k$ and those of the 8 kbps mode pulses are denoted $S_k$. Table 8 below gives the selected positions in each case. The columns labeled "$P_{j+d}=P_i$" specify the neighborhood law at the level of the tracks and terminating at the track $P_i$. At the level of the tracks $P_i$:

for the right-hand neighborhood: $P_i \Rightarrow P_{(i+d)\equiv 5}$ for the left-hand neighborhood: $P_i \Rightarrow P_{(i-d)\equiv 5}$ Accordingly, a right-hand (respectively left-hand) neighborhood of +1 (respectively −1) of the pulse (p,m) belongs to $T'_{p+1}$ if p<4 (respectively to $T'_{p-1}$ if p>0), if not (p=4) to $T'_0$ on condition that m<7 (respectively to $T'_4$ (I=0) on condition that m>0). The restriction on the right-hand neighbor for a position of the fourth pulse belonging to the fourth track (respectively left-hand neighbor for a position of the first track) ensure that adjacent position is not outside the sub-frame.

TABLE 8

Selection of the 8 kbps mode G.729 restricted directory from two pulses of the 6.4 kbps mode G.729 ACELP directory

| $e_0$ (Track) | $e_1$ (Track) | $s_0$ Pos | $s_0$ $P_{i+d}=P_0$ | $s_1$ Pos | $s_1$ $P_{i+d}=P_1$ | $s_2$ Pos | $s_2$ $P_{i+d}=P_2$ | $s_3$ Pos | $s_3$ $P_{i+d}=P_3/P_4$ |
|---|---|---|---|---|---|---|---|---|---|
| $p_1$ | $e_0=e_1$ $p_1$ | $e_1-1$ | $p_1-1$ | $E_1$ | $p_1$ | $e_1+1$ | $p_1+1$ | $e_1+2$ | $p_1+2$ |
| | $e_0\neq e_1$ | $e_0-1$ | $p_1-1$ | $E_0$ | $p_1$ | $e_1+1$ | $p_1+1$ | $e_1+2$ | $P_1+2$ |
| $p_1$ | $p_0$ | $e_1$ | $p_0$ | $E_0$ | $p_1$ | $e_0+1$ | $p_1+1$ | $e_1+1^{(1)}$ | $p_0^{(1)}-1$ |
| $p_1$ | $p_2$ | $e_0-1$ | $p_1-1$ | $E_0$ | $p_1$ | $e_1$ | $p_2$ | $e_1+1$ | $p_2+1$ |
| $p_1$ | $p_4$ | $e_1+1^{(2)}$ | $p_4^{(2)}+1$ | $E_0$ | $p_1$ | $e_0-1$ | $p_1+1$ | $e_1$ | $p_4$ |
| $p_3$ | $p_0$ | $e_1$ | $p_0$ | $E_1+1$ | $p_0+1$ | $e_0-1$ | $p_3-1$ | $e_0$ | $p_3$ |
| $p_3$ | $p_1$ | $e_1-1$ | $p_1-1$ | $E_1$ | $p_1$ | $e_0-1$ | $p_3-1$ | $e_0$ | $p_3$ |
| $p_3$ | $p_2$ | $e_0+2^{(3)}$ | $p_3^{(3)}+2$ | $E_0-1$ | $p_2-1$ | $e_1$ | $p_2$ | $e_0$ | $p_3$ |
| $p_3$ | $P_4$ | $e_1+1^{(4)}$ | $p_4^{(4)}+1$ | $E_0-2$ | $p_3-2$ | $e_0-1$ | $p_3-1$ | $e_1$ | $p_4$ |

The aim is therefore preferably to balance the distribution of the four positions relative to the two starting positions, although a different choice may be made. Four situations (indicated by an exponent in parentheses in Table 8) may nevertheless give rise to edge effect problems:

Situation (1): if $e_1=0$, we cannot take $s_3=e_1-1$, so we choose $s_3=e_0+2$.

Situation (2): if $e_1=39$, we cannot take $s_0=e_1+1$, so we choose $s_0=e_0-1$.

Situation (3): if $e_1=38$, we cannot take $s_0=e_0+2$, so we choose $s_0=e_1-2$.

Situation (4): if $e_1=39$, we cannot take $s_0=e_1+1$, so we choose $s_0=e_0-3$.

To reduce complexity further, the sign of each pulse $S_k$ may be taken as equal to that of the pulse $e_j$ from which it is deduced.

The selection of a subensemble of the 6.4 kbps mode G.729 ACELP directory with two pulses from an element of an 8 kbps mode G.729 ACELP directory with four pulses is described next.

For an 8 kbps mode G.729 subframe, the first step is to recover the positions of the four pulses generated by the 8 kbps mode. Decoding the binary index (on 13 bits) of these four positions yields their rank in their respective track for the first three positions (tracks 0 to 2) and the track (3 or 4) of the fourth pulse together with its rank in that track. Each position $e_i$ ($0\leqq i<4$) is characterized by the pair ($p_i$,$m_i$) in which $p_i$ is the index of its track and $m_i$ is its rank in that track. We have:

$$e_i=5m_i+p_i$$

with $0\leqq m_i<8$ and $p_i=i$ for I<3 and $p_3=3$ or 4.

As already mentioned, neighborhood extraction and restricted subensemble composition are combined and advantageously exploit the ISSP structure common to the two directories. The five intersections $T'_j$ of the ensemble $P_s$ of the neighborhoods of the four positions with the five tracks $P_j$ are constructed by exploiting the adjacent position property induced by interleaving the tracks:

$$T'_j=P_s\cap P_j$$

Accordingly, using the modulo 5 notation (≡5), a right-hand (respectively left-hand) neighbor of +1 (respectively −1) of the pulse (p,m) belongs to $T'_{(p+1)\equiv 5}$ (respectively to $T'_{(p-1)\equiv 5}$). Note that it is necessary to take account of edge effects. Generalizing to a neighborhood size d, a right-hand neighbor of +d (respectively a left-hand neighbor of −d) of the pulse (p,m) belongs to $T'_{(p+d)\equiv 5}$ (respectively $T'_{(p-d)\equiv 5}$). The rank of the neighbor of ±d is equal to m if $p+d\leqq 4$ (or $p-d\geqq 0$), otherwise the rank m is incremented for a right-hand neighbor and decremented for a left-hand neighbor. Taking account of edge effects therefore amounts to ensuring that m<7 if p+d>4 and m>0 if p−d<0.

Starting from this distribution of the neighbors in the five tracks, it is a simple matter to determine the subensembles $S_0$ and $S_1$ of the positions of the two pulses:

$$S_0=T'_1\cup T'_3 \text{ and } S_1=T'_0\cup T'_1\cup T'_2\cup T'_4$$

The fourth and final step consists in searching for the optimum pair in the two subensembles obtained. The search algorithm (like the standardized algorithm exploiting the track structure) and the track by track storage of pulses once again simplify the search algorithm. In practice, it is therefore of no utility to construct the restricted subensembles $S_0$ and $S_1$ explicitly, as the ensembles $T'_j$ can be used alone.

In the following example, the four 8 kbps mode G.729 pulses have been placed at the following positions:

$$e_0=5;\ e_1=21;\ e_2=22;\ e_3=34.$$

Those four positions are characterized by the four pairs ($p_i$, $m_i$)=(0,1), (1, 4), (2,4) (4,6).

Taking a fixed neighborhood equal to 1, the five intersections $T'_j$ are constructed as follows:

$e_0$: (0,1) yields: (4,0) on the left and (1,1) on the right $e_1$: (1,4) yields: (0,4) on the left and (2,4) on the right $e_2$: (2,4) yields: (1,4) on the left and (3,4) on the right $e_3$: (4,6) yields: (3,6) on the left and (0,7) on the right Thus we have:

$T'_0=\{(0,1), (0,4), (0,7)\}$ $T'_1=\{(1,4), (1,1))\}$ $T'_2=\{(2,4)\}$
$T'_3=\{(3,4), (3,6)\}$
$T'_4=\{(4,6), (4,0)\}$

Reverting to the position notation:

$T'_{0=}\{5,20,35\}$
$T'_1=\{21, 6\}$
$T'_2=\{22\}$
$T'_3=\{23,33\}$
$T'_4=\{34,4\}$

In the final step, an algorithm similar to that of the G.729 6.4 kbps mode effects the search for the best pair of pulses. That algorithm is much less complex here as the number of combinations of positions to be explored is very small. In the example, there number of combinations to be tested is only 4 (Cardinal($T'_1$)+Cardinal($T'_3$)) multiplied by 8 (Cardinal ($T'_0$)+Cardinal($T'_1$)+Cardinal($T'_2$)+Cardinal($T'_4$)), i.e. 32 combinations instead of 512.

For a neighborhood of size 1, less than 8% of the combinations of positions are to be explored on average, without exceeding 10% (50 combinations). For a neighborhood of size 2, less than 17% of combinations of positions are to be explored on average and at most 25% of the combinations are to be explored. For a neighborhood of size 2, the complexity of the processing proposed by the invention (lumping together the cost of searching the restricted directory and the cost of extracting the neighborhoods associated with the composition of the intersections) represents less than 30% of an exhaustive search for an equivalent quality.

Embodiment No. 3

The final embodiment illustrates passing between the 8 kbps mode G.729 ACELP model and the 6.3 kbps mode G.723.1 MP-MLQ model.

Intelligent transcoding of the pulses between G.723.1 (6.3 kbps mode) and G.729 (8 kbps mode) entails two major difficulties. Firstly, the size of the frames is different (40 samples for G.729 as against 60 samples for G.723.1). The second difficulty is linked to the different structures of the dictionaries (ACELP type for G.729 and MP-MLQ type for G.723.1). The embodiment described here shows how the invention eliminates these two problems in order to transcode the pulses at reduced cost whilst preserving transcoding quality.

Figure 4B:
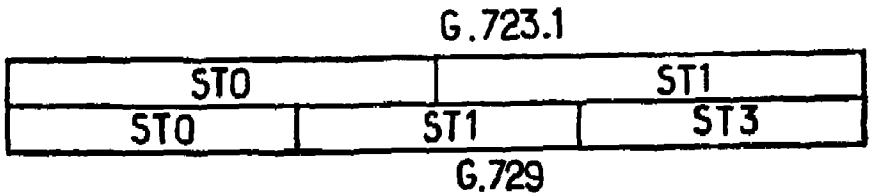
FIG. 4*b* represents a practical implementation of FIG. 4 showing the time correspondence between a G.723.1 coder and a G.729 coder.

First of all a temporal correspondence is set up between the positions in the two formats, taking account of the size difference of the subframes to align the positions relative to an origin common to E and S. The G.729 and G.723.1 subframe lengths having a lowest common multiple of 120, the temporal correspondence is set up by blocks of 120 samples, i.e. two G.723.1 subframes for every three G.729 subframes, as shown in the FIG. 4*b* example. Alternatively, it might be preferable to work on complete blocks of frames. In this case, blocks of 240 samples are chosen, i.e. a G.723.1 frame (four subframes) for every three G.729 frames (six subframes).

There is described next the selection of a subensemble of the 6.3 kbps mode G.723.1 MP-MLQ directory from elements of the 8 kbps mode G.729 ACELP directory with four pulses. The first step consists in recovering the positions of the pulses by blocks of three G.729 subframes (with index $i_e$, $0 \leqq i_e \leqq 2$). The position of that block in the subframe $i_e$ is denoted $p_e(i_e)$.

Before neighborhood extraction, the 12 positions $p_e(i_e)$ are converted into 12 positions $p_s(j_s)$ divided into two G.723.1 subframes (of index $j_s 0 \leqq j_s \leqq 1$). The above general equation may be used (involving the modulus of the subframe length) to perform the adaptation of the subframe durations. However, it is preferred here merely to distinguish three situations according to the value of the index $i_e$:

if $i_e=0$, then $j_s=0$and $p_s=p_e$
if $i_e=2$, then $j_s=1$and $p_s=p_e+20$
if $i_e=1$, then if $P_e<20 j_s=0$ and $p_s=p_e+40$,
if not ($p_e \geqq 20$): $j_s=1$ and $p_s=p_e-20$ Thus no division and no operation modulo n are effected.

The four positions recovered in the subframe STE0 of the block are directly assigned to the subframe STS0 with the same position, those of the subframe STE2 of the block are directly assigned to the subframe STS1 with a position increment of +20, the positions of the subframe STE1 below 20 are assigned to the subframe STS0 with an increment of +40, and the others are assigned to the subframe STS1 with an increment of −20.

The neighborhoods of those 12 positions are then extracted. Note that the right-hand (respectively left-hand) neighborhoods of the positions of the subframe STS0 (respectively STS1) to be extracted from their subframe can be authorized, these neighbor positions being then in the subframe STS1 (respectively STS0).

The temporal correspondence and neighborhood extraction steps can be interchanged. In this case, the right-hand (respectively left-hand) neighborhoods of the positions of the subframe STE0 (respectively STE2) to be extracted from their subframe can be authorized, those neighbor positions then being in the subframe STE1. Similarly, the right-hand (respectively left-hand) neighborhoods of the positions in STE1 can lead to neighbor positions in STE2 (respectively STE0).

Once the ensemble of restricted positions for each subframe STS has been constituted, the final step consists in exploring the restricted directory constituted in this way for each subframe STS to select the $N_p$ (=6 or 5) pulses with the same parity. This procedure can be derived from the standardized algorithm or take its inspiration from other focusing procedures.

To illustrate this embodiment, consider three G.729 subframes that can be used to construct the subdirectories of two G.723.1 subframes. Assume that G.729 yields the following positions:

STE0 : $e_{00}=5$; $e_{01}=1$; $e_{02}=3$; $e_{03}=39$;
STE1 : $e_{10}=15$; $e_1=31$; $e_{12}=22$; $e_{13}=4$;
STE2 : $e_{20}=0$; $e_{21}=1$; $e_{22}=37$; $e_{23}=24$.

After application of the above temporal correspondence step, the assignment of these 12 positions to the subframes STS0 and STS1 is as follows:

STS0 : $s_{00}=5$; $s_{0\ 1}=1$; $S_{02}=32$; $S_{03}=39$ ($S_{0k}=e_{0k}$)
STS0 : $s'_1=55$; $s'_{13}=44$ ($s'_{0k}=e_{1k}+40$, if $e_{1k}<20$)
STS1 : $s'_{11}=11$; $s'_{12}=2$ ($s'_{1k}=e_{1k}-20$, if $e_{1k} \geqq 20$)
STS1 : $s_{20}=20$; $s_{21}=21$; $s_{22}=57$; $s_{23}=44$ ($s_{0k}=e_{2k}+20$)

Thus we have the sets of positions {1, 5, 32, 39, 44, 55} for the subframe STS0 and {2, 11, 20, 21, 44, 57} for the subframe STS1.

At this stage it is necessary to extract the neighborhoods. Taking a neighborhood fixed at 1, for example, we obtain:

$$P_{s0}=\{0,1,2\}\cup\{4,5,6\}\cup\{31,32,33\}\cup\{38,39,40\}\cup\{43,44,45\}\cup\{54,55,56\}$$

$$P_{s1}=\{1,2,3\}\cup\{10,11,12\}\cup\{20,21,22\}\cup\{21,22,23\}\cup\{43,44,45\}\cup\{56,57,58\}$$

MP-MLQ imposes no constraint on the pulses, apart from their parity. Over a subframe, they must all have the same parity. It is therefore necessary here to split $P_{s0}$ and $P_{s1}$ into two subensembles, as follows:

$P_{s0}$: {0,2,4,6,32,40,44,54,56} and {1,5,31,33,39,43,45,55}

$P_{s1}$: {2,10,12,20,22,44,56} and {1,3,11,21,23,43,45,57}

Finally, this subdirectory is transmitted to the selection algorithm that determines the $N_p$ best positions in the sense of the CELP criterion for the G.723.1 subframes FTS0 et STS1 .This considerably reduces the number of combinations to be tested. For example, there remain in the subframe STS0 nine even positions and eight odd positions, rather than 30 and 30.

Certain precautions are nevertheless required in situations in which the positions selected by G.729 are such that the extraction of the neighborhoods yields a number N of possible positions lower than the G.723.1 number of positions ($N < N_p$). This is the case in particular if the G.729 positions are all in sequence (for example: {0,1,2,3}). There are then two options:

either to increase the size of the neighborhood for the subframes concerned until a sufficient size is obtained for $P_s$ (size$\geqq N_p$);

or to select the first N pulses and authorize for the remaining $N_p$−N pulses a search among the 30−N remaining positions of the grid, as described above.

The opposite processing operation, consisting in selecting a subensemble of the 8 kbps mode G.729 ACELP directory with four pulses from elements of a 6.3 kbps mode G.723.1 MP-MLQ directory, is described next.

Overall, the process is similar. Two G.723.1 subframes correspond to three G.729 frames. Once again, the G.723.1 positions are extracted and translated into the G.729 time frame. These positions could advantageously be translated in the form "track−rank in the track" in order to benefit as before from the ACELP structure to extract the neighborhoods and search for the optimum positions.

The same arrangements as before are adopted to prevent situations in which neighborhood extraction would yield an insufficient number of positions (here fewer than four positions).

Thus the present invention determines at lower cost the positions of a set of pulses from a first set of pulses, the two sets of pulses belonging to two multipulse directories. Those two directories may be distinguished by their size, the length and the number of pulses of their code words, and the rules governing the positions and/or amplitudes of the pulses. Preference is given to the neighborhoods of the positions of the pulses of the selected set(s) in the first directory to determine those of a set in the second directory. The invention further exploits the structure of the starting and/or destination directories to reduce complexity further. From the first embodiment described above entailing changing from an MP-MLQ model to a ACELP model, it will be clear that the invention is easy to apply to two multipulse models having different structural constraints. From the second embodiment, entailing passing between two models having different numbers of pulses based on the same ACELP structure, it will be clear that the invention advantageously exploits the structure of the directories to reduce transcoding complexity. From the third embodiment, entailing passing between an MP-MLQ model and an ACELP model, it will be clear that the invention may even be applied to coders with different subframe lengths or sampling frequencies. The invention adjusts the quality/complexity trade-off and in particular greatly reduces the calculation complexity for a minimum deterioration compared to a conventional search of a multipulse model.

The invention claimed is:

1. A method for a transcoder for transcoding between a first compression codec and a second compression codec, said first and second codecs being of pulse type and using multipulse dictionaries in which each pulse has a position marked by an associated index, wherein the method comprises the steps performed by the transcoder:

a) the transcoder adapting coding parameters between said first and second codecs;

b) a decoder of the transcoder obtaining from the first codec a selected number of pulse positions and respective position indices associated therewith;

c) for each current pulse position of given index, a module of the transcoder forming a group of pulse positions including at least the current pulse position and the pulse positions with associated indices immediately below and immediately above the given index;

d) selecting as a function of pulse positions accepted by the second codec at least some of the pulse positions in an ensemble constituted by a union of said groups formed in step c); and e) sending the selected pulse positions to the second codec for coding/decoding from the positions sent; said selection step d) then involving a number of pulse positions less than the total number of pulse positions in the dictionary of the second codec.

2. A method according to claim 1, wherein said first codec is adapted to deliver a succession of coded frames and the respective numbers of pulse positions in the groups formed in step c) are selected successively from one frame to the other.

3. A method according to claim 1, the first codec using a first number of pulses in a first coding format, and said selected number in step b) corresponds to said first number of pulse positions.

4. A method according to claim 3:

the first codec using a first number of pulse positions in a first coding format; and the second using a second number of pulse positions in a second coding format; wherein the method further includes a step of discriminating between the following situations:

the first number is greater than or equal to the second number; and the first number is less than the second number.

5. A method according to claim 4, wherein:

the first number is less than the second number, a further test is effected to determine if the pulse positions provided in the second number of pulse positions are included in the pulse positions of the groups formed in step c), and, in the event of a negative result of said test, the number of pulse positions in the groups formed in step c) is increased.

6. A method according to claim 4, wherein it further discriminates the situation in which the second number $N_s$ is between the first number $N_e$ and twice the first number $N_e$ ($N_e<N_s<2N_e$) and if so:

c1) the $N_e$ pulse positions are selected from the outset; and c2) there is further selected a complementary number of pulse positions $N_s$-$N_e$ defined in the immediate neighborhood of the pulse positions selected in step c1).

7. A method according to claim 4, wherein the first number is greater than or equal to the second number, and each group formed in step c) includes right-hand neighbor pulse positions and left-hand neighbor pulse positions of said current pulse position of given index and the respective numbers of left-hand and right-hand neighbor pulse positions are selected as a function of a complexity/transcoding quality trade-off.

8. A method according to claim 7, wherein there is constructed in step d) a subdirectory of combinations of pulse positions resulting from intersections of:

an ensemble constituted by a union of said groups formed in step c); and pulse positions accepted by the second codec, so that said subdirectory has a size less than the number of pulse position combinations accepted by the second codec.

9. A method according to claim 8, wherein, after step e), said subdirectory is searched for an optimum set of positions including said second number of positions at the level of the second coder.

10. A method according to claim 9, wherein the step of searching for the optimum set of positions is effected by means of a focused search to accelerate the exploration of said subdirectory.

11. A method according to claim 1, wherein:

said first codec operating with a given first sampling frequency and from a given first subframe duration, said coding parameters for which said adaptation is carried out in step a) include a subframe duration and a sampling frequency, and said second codec operating with a second sampling frequency and a second subframe duration, and the following four situations are distinguished in step a):

the first and second durations are equal and the first and second frequencies are equal;

the first and second durations are equal and the first and second frequencies are different;

the first and second durations are different and the first and second frequencies are equal; and the first and second durations are different and the first and second frequencies are different.

12. A method according to claim 11, wherein the first and second durations are equal and the first and second sampling frequencies are different, and wherein the method comprises the steps of:

a'1) oversampling a subframe with the first coding format characterized by the first sampling frequency at a frequency equal to the lowest common multiple of the first and second sampling frequencies; and a'2) applying to the oversampled subframe low-pass filtering followed by undersampling to obtain a sampling frequency corresponding to the second sampling frequency.

13. A method according to claim 12, wherein the method continues by obtaining, by means of a thresholding method, a number of positions which can be variable where appropriate.

14. A method according to claim 11, wherein the first and second durations are equal and the first and second sampling frequencies are different, and wherein the method includes steps of:

a1) direct time scale quantization from the first frequency to the second frequency; and a2) determination as a function of said quantization of each pulse position in a subframe with the second coding format characterized by the second sampling frequency from a pulse position in a subframe with the first coding format characterized by the first sampling frequency.

15. A method according to claim 14, wherein the quantization step a1) is effected by calculation and/or tabulation on the basis of a function which at a pulse position in a subframe with the first format establishes the correspondence of a pulse position in a subframe with the second format, said function substantially taking the form of a linear combination involving a multiplier coefficient corresponding to the ratio of the second sampling frequency to the first sampling frequency.

16. A method according to claim 15, wherein, to pass conversely a pulse position in a subframe with the second format to a pulse position in a subframe with the first format, there is applied an inverse function to said linear combination applied to a pulse position in a subframe with the second format.

17. A method according to claim 14, wherein it further includes a step of establishing the correspondence for each position of a pulse of a subframe with the first coding format characterized by the first sampling frequency of a group of pulse positions in a subframe with the second coding format characterized by the second sampling frequency, each group including a number of positions that is a function of the ratio between the second sampling frequency and the first sampling frequency.

18. A method according to claim 11, wherein the first and second subframe durations are different, and wherein the method includes the steps of:

a20) defining an origin common to the subframes of the first and second formats;

a21) dividing successive subframes of the first coding format characterized by a first subframe duration to form pseudosubframes of duration corresponding to the subframe duration of the second format;

a22) updating said common origin; and a23) determining the correspondence between the pulse positions in the pseudosubframes and in the subframes with the second format.

19. A method according to claim 18, wherein it also discriminates the following situations:

the first and second durations are fixed in time; and the first and second durations vary in time.

20. A method according to claim 19, wherein the first and second durations are fixed in time and the position in time of said common origin is periodically updated whenever boundaries of respective subframes of first and second duration are aligned in time.

21. A method according to claim 19, wherein the first and second durations vary in time and:

a221) respective summations of the durations of subframes with the first format and the durations of subframes with the second format are effected successively;

a222) equality of the two summations is detected, defining a time of updating said common origin; and a223) said two summations are reset, after said equality is detected, for future detection of a next common origin.

22. A software product adapted to be stored in a memory of a processor unit, in particular a computer or a mobile terminal, or in a removable memory medium adapted to cooperate with a reader of the processor unit, the software product including instructions that when executed by the processor unit implement a method of a transcoder for transcoding between a first compression codec and a second compression codec, said first and second codecs being of pulse type and using multipulse dictionaries in which each pulse has a position marked by an associated index, said method including the following steps to be performed by the transcoder:

a) adapting coding parameters between said first and second codecs;

b) a decoder of the transcoder obtaining from the first codec a selected number of pulse positions and respective position indices associated therewith;

c) for each current pulse position of given index, a module of the transcoder forming a group of pulse positions including at least the current pulse position and the pulse positions with associated indices immediately below and immediately above the given index;

d) selecting as a function of pulse positions accepted by the second codec at least some of the pulse positions in an ensemble constituted by a union of said groups formed in step c); and e) sending the selected pulse positions to the second codec for coding/decoding from the positions sent; said selection step d) then involving a number of pulse positions less than the total number of pulse positions in the dictionary of the second codec.

23. A transcoder for transcoding between a first compression codec and a second compression codec, said first and second codecs being of the pulse type and using multipulse dictionaries in which each pulse has a position marked by an associated index, said transcoder comprising a memory adapted to store instructions of a software product comprising computer readable instructions that when executed by the transcoder carry out the following steps to be performed by the transcoder:

a) adapting coding parameters between said first and second codecs;

b) a decoder of the transcoder obtaining from the first codec a selected number of pulse positions and respective position indices associated therewith;

c) for each current pulse position of given index, a module of the transcoder forming a group of pulse positions including at least the current pulse position and the pulse positions with associated indices immediately below and immediately above the given index;

d) selecting as a function of pulse positions accepted by the second codec at least some of the pulse positions in an ensemble constituted by a union of said groups formed in step c); and e) sending the selected pulse positions to the second codec for coding/decoding from the positions sent;

said selection step d) then involving a number of pulse positions less than the total number of pulse positions in the dictionary of the second codec.

* * * * *